US007088306B2

(12) United States Patent
Chiang et al.

(10) Patent No.: US 7,088,306 B2
(45) Date of Patent: Aug. 8, 2006

(54) HIGH GAIN ANTENNA FOR WIRELESS APPLICATIONS

(75) Inventors: Bing Chiang, Melbourne, FL (US); Michael James Lynch, Merritt Island, FL (US); Douglas Harold Wood, Palm Bay, FL (US)

(73) Assignee: IPR Licensing, Inc., Wilmington, DE (US)

( * ) Notice: Subject to any disclaimer, the term of this patent is extended or adjusted under 35 U.S.C. 154(b) by 0 days.

(21) Appl. No.: 11/063,118

(22) Filed: Feb. 22, 2005

(65) Prior Publication Data

US 2005/0212714 A1 Sep. 29, 2005

Related U.S. Application Data

(63) Continuation of application No. 10/444,322, filed on May 23, 2003, now Pat. No. 6,864,852, which is a continuation-in-part of application No. 09/845,133, filed on Apr. 30, 2001, now Pat. No. 6,606,057.

(51) Int. Cl.
*H01Q 21/00* (2006.01)

(52) U.S. Cl. ..... 343/817; 343/810; 343/818

(58) Field of Classification Search ..... 343/810, 343/817, 818, 834
See application file for complete search history.

(56) References Cited

U.S. PATENT DOCUMENTS

| | | | | |
|---|---|---|---|---|
| 2,928,087 A | | 3/1960 | Parker | 343/106 |
| 3,109,175 A | | 10/1963 | Lloyd | 343/761 |
| 3,560,978 A | | 2/1971 | Himmel et al. | 343/106 |
| 3,846,799 A | | 11/1974 | Gueguen | 343/833 |
| 3,996,592 A | | 12/1976 | Kline et al. | 343/120 |
| 4,071,847 A | | 1/1978 | Pickles | 343/761 |
| 4,329,690 A | | 5/1982 | Parker | 343/709 |
| 4,387,378 A | | 6/1983 | Henderson | 343/854 |
| 4,555,708 A | | 11/1985 | Waineo et al. | 343/799 |
| 4,700,197 A | | 10/1987 | Milne | 343/837 |
| 5,132,698 A | | 7/1992 | Swineford | 343/846 |
| 5,293,172 A | * | 3/1994 | Lamberty et al. | 343/701 |
| 5,506,591 A | * | 4/1996 | Dienes | 343/792 |
| 5,617,102 A | | 4/1997 | Prater | 342/374 |

(Continued)

FOREIGN PATENT DOCUMENTS

EP 1035614 9/2000

OTHER PUBLICATIONS

Kraus, Antennas, Second Edition, McGraw Hill (Series in Electrical Engineering, Electronics & Electronic Circuits), 1988, pp. 754-762.

(Continued)

*Primary Examiner*—Tho Phan
(74) *Attorney, Agent, or Firm*—Allen, Dyer, Doppelt, Milbrath & Gilchrist, P.A.

(57) ABSTRACT

An antenna includes a ground plane and an active antenna element adjacent the ground plane. Passive antenna elements are adjacent the ground plane, and are spaced apart from the active antenna element. First parasitic gratings are adjacent the ground plane and are spaced apart from the active antenna element. Each first parasitic grating is between two adjacent passive antenna elements. A controller selectably controls the passive antenna elements for operating in a reflective mode or a directive mode. The controller includes for each respective passive antenna element at least one impedance element connected to the ground plane, and a switch adjacent the ground plane for connecting the at least one impedance element to the passive antenna element so that the passive antenna element operates in the reflective or directive mode.

22 Claims, 15 Drawing Sheets

U.S. PATENT DOCUMENTS

| | | | | |
|---|---|---|---|---|
| 5,629,713 | A | 5/1997 | Mailandt et al. | 343/808 |
| 5,872,547 | A | 2/1999 | Martek | 343/815 |
| 5,905,473 | A | 5/1999 | Taenzer | 343/834 |
| 6,317,092 | B1 | 11/2001 | De Schweinitz et al. | 343/753 |
| 6,369,770 | B1 | 4/2002 | Gothard et al. | 343/794 |
| 6,407,719 | B1 | 6/2002 | Ohira et al. | 343/893 |
| 6,606,057 | B1 | 8/2003 | Chiang et al. | 342/374 |
| 6,888,504 | B1 * | 5/2005 | Chiang et al. | 343/702 |
| 2002/0003497 | A1 | 1/2002 | Gilbert et al. | 343/700 MS |
| 2002/0024468 | A1 | 2/2002 | Palmer et al. | 343/702 |

OTHER PUBLICATIONS

Ohira et al., Electronically Steerable Passive Array Radiator Antennas for Low-Cost Analog Adaptive Beamforming, 0-7803-6345-0/00, 2000, IEEE.

Scott et al., Diversity Gain From a Single-Port Adaptive Antenna Using Switched Parasitic Elements Illustrated with a Wire and Monopole Prototype, IEEE Transactions on Antennas and Propagation, vol. 47, No. 6, Jun. 1999.

King, The Theory of Linear Antennas, pp. 622-637, Harvard University Press, Cambridge, Mass., 1956.

Lo et al., Antenna Handbook: Theory, Applications and Design, pp. 21-38, Van Nostrand Reinhold Co., New York, 1988.

* cited by examiner

LENGTHS: L1 = L2 = 1.5"; L3 = 1.37"; L4 = 1.265"
SPACINGS: S1 = 0.54"; S2 = 1.512"; S3 = 1.692"

HIGH GAIN ANTENNA FOR WIRELESS APPLICATIONS

This patent application is a continuation of U.S. patent application Ser. No. 10/444,322 filed on May 23, 2003 now U.S. Pat. No. 6,864,852 which is a continuation-in-part of U.S. patent application Ser. No. 09/845,133 filed on Apr. 30, 2001, now U.S. Pat. No. 6,606,057.

FIELD OF THE INVENTION

This invention relates to mobile or portable cellular communication systems and more particularly to an antenna apparatus for use in such systems, wherein the antenna apparatus offers improved beam-forming capabilities by increasing the antenna gain in the azimuth direction.

BACKGROUND OF THE INVENTION

Code division multiple access (CDMA) communication systems provide wireless communications between a base station and one or more mobile or portable subscriber units. The base station is typically a computer-controlled set of transceivers that are interconnected to a land-based public switched telephone network (PSTN). The base station further includes an antenna apparatus for sending forward link radio frequency signals to the mobile subscriber units and for receiving reverse link radio frequency signals transmitted from each mobile unit. Each mobile subscriber unit also contains an antenna apparatus for the reception of the forward link signals and for the transmission of the reverse link signals. A typical mobile subscriber unit is a digital cellular telephone handset or a personal computer coupled to a cellular modem. In such systems, multiple mobile subscriber units may transmit and receive signals on the same center frequency, but different modulation codes are used to distinguish the signals sent to or received from individual subscriber units.

In addition to CDMA, other wireless access techniques employed for communications between a base station and one or more portable or mobile units include time division multiple access (TDMA), the global system for mobile communications (GSM), the various 802.11 standards described by the Institute of Electrical and Electronics Engineers (IEEE) and the so-called "Bluetooth" industry-developed standard. All such wireless communications techniques require the use of an antenna at both the receiving and transmitting end. Any of these wireless communications techniques, as well as others known in the art, can employ one or more antennas constructed according to the teachings of the present invention. Increased antenna gain, as taught by the present invention, will provide improved performance for all wireless systems.

The most common type of antenna for transmitting and receiving signals at a mobile subscriber unit is a monopole or omnidirectional antenna. This antenna consists of a single wire or antenna element that is coupled to a transceiver within the subscriber unit. The transceiver receives reverse link audio or data for transmission from the subscriber unit and modulates the signals onto a carrier signal at a specific frequency and modulation code (i.e., in a CDMA system) assigned to that subscriber unit. The modulated carrier signal is transmitted by the antenna. Forward link signals received by the antenna element at a specific frequency are demodulated by the transceiver and supplied to processing circuitry within the subscriber unit.

The signal transmitted from a monopole antenna is omnidirectional in nature. That is, the signal is sent with approximately the same signal strength in all directions in a generally horizontal plane. Reception of a signal with a monopole antenna element is likewise omnidirectional. A monopole antenna alone cannot differentiate a signal received in one azimuth direction from the same or a different signal coming from another azimuth direction. Also, a monopole antenna does not produce significant radiation in the zenith direction. The antenna pattern is commonly referred to as a donut shape with the antenna element located at the center of the donut hole.

A second type of antenna that may be used by mobile subscriber units is described in U.S. Pat. No. 5,617,102. The system described therein provides a directional antenna system comprising two antenna elements mounted on the outer case of a laptop computer, for example. The system includes a phase shifter attached to each element. The phase shifters impart a phase angle delay to the signal input thereto, thereby modifying the antenna pattern (which applies to both the receive and transmit modes) to provide a concentrated signal or beam in a selected direction. Concentrating the beam is referred to as an increase in antenna gain or directivity. The dual element antenna of the cited patent thereby directs the transmitted signal into predetermined sectors or directions to accommodate for changes in orientation of the subscriber unit relative to the base station, thereby minimizing signal losses due to the orientation change. The antenna receive characteristics are similarly effected by the use of the phase shifters.

CDMA cellular systems are recognized as interference limited systems. That is, as more mobile or portable subscriber units become active in a cell and in adjacent cells, frequency interference increases and thus bit error rates also increase. To maintain signal and system integrity in the face of increasing error rates, the system operator decreases the maximum data rate allowable for one or more users, or decreases the number of active subscriber units, which thereby clears the airwaves of potential interference. For instance, to increase the maximum available data rate by a factor of two, the number of active mobile subscriber units can be decreased by one half. However, this technique is not typically employed to increase data rates due to the lack of priority assignments for individual system users. Finally, it is also possible to avert excessive interference by using directive antennas at both (or either) the base station and the portable units.

Generally, a directive antenna beam pattern can be achieved through the use of a phased array antenna. The phased array is electronically scanned or steered to the desired direction by controlling the phase of the input signal to each of the phased array antenna elements. However, antennas constructed according to these techniques suffer decreased efficiency and gain as the element spacing becomes electrically small compared to the wavelength of the transmitted or received signal. When such an antenna is used in conjunction with a portable or mobile subscriber unit, the antenna array spacing is relatively small and thus antenna performance is correspondingly compromised.

Various disadvantages are inherent in prior art antennas used on mobile subscriber units in wireless communications systems. One such problem is called multipath fading. In multipath fading, a radio frequency signal transmitted from a sender (either a base station or mobile subscriber unit) may encounter interference in route to the intended receiver. The signal may, for example, be reflected from objects, such as buildings, thereby directing a reflected version of the original signal to the receiver. In such instances, the receiver receives two versions of the same radio signal; the original version and a reflected version. Each received signal is at the same frequency, but the reflected signal may be out of phase with the original signal due to the reflection and consequent differential transmission path length to the receiver. As a result, the original and reflected signals may partially or completely cancel each other (destructive interference), resulting in fading or dropouts in the received signal, hence the term multipath fading.

Single element antennas are highly susceptible to multipath fading. A single element antenna has no way of determining the direction from which a transmitted signal is sent and therefore cannot be turned to more accurately detect and receive a signal in any particular direction. Its directional pattern is fixed by the physical structure of the antenna. Only the antenna physical position or orientation (e.g., horizontal or vertical) can be changed in an effort to obviate the multipath fading effects.

The dual element antenna described in the aforementioned reference is also susceptible to multipath fading due to the symmetrical and opposing nature of the hemispherical lobes formed by the antenna pattern when the phase shifter is activated. Since the lobes created in the antenna pattern are more or less symmetrical and opposite from one another, a signal reflected toward the backside of the antenna (relative to a signal originating at the front side) can be received with as much power as the original signal that is received directly. That is, if the original signal reflects from an object beyond or behind the intended receiver (with respect to the sender) and reflects back at the intended receiver from the opposite direction as the directly received signal, a phase difference in the two signals creates destructive interference due to multipath fading.

Another problem present in cellular communication systems is inter-cell signal interference. Most cellular systems are divided into individual cells, with each cell having a base station located at its center. The placement of each base station is arranged such that neighboring base stations are located at approximately sixty-degree intervals from each other. Each cell may be viewed as a six-sided polygon with a base station at the center. The edges of each cell abut and a group of cells form a honeycomb-like image if each cell edge were to be drawn as a line and all cells were viewed from above. The distance from the edge of a cell to its base station is typically driven by the minimum power required to transmit an acceptable signal from a mobile subscriber unit located near the edge of the cell to that cell's base station (i.e., the power required to transmit an acceptable signal a distance equal to the radius of one cell).

Intercell interference occurs when a mobile subscriber unit near the edge of one cell transmits a signal that crosses over the edge into a neighboring cell and interferes with communications taking place within the neighboring cell. Typically, signals in neighboring cells on the same or closely spaced frequencies cause intercell interference. The problem of intercell interference is compounded by the fact that subscriber units near the edges of a cell typically employ higher transmit powers so that their transmitted signals can be effectively received by the intended base station located at the cell center. Also, the signal from another mobile subscriber unit located beyond or behind the intended receiver may arrive at the base station at the same power level, causing additional interference.

The intercell interference problem is exacerbated in CDMA systems, since the subscriber units in adjacent cells typically transmit on the same carrier or center frequency. For example, generally, two subscriber units in adjacent cells operating at the same carrier frequency but transmitting to different base stations interfere with each other if both signals are received at one of the base stations. One signal appears as noise relative to the other. The degree of interference and the receiver's ability to detect and demodulate the intended signal is also influenced by the power level at which the subscriber units are operating. If one of the subscriber units is situated at the edge of a cell, it transmits at a higher power level, relative to other units within its cell and the adjacent cell, to reach the intended base station. But, its signal is also received by the unintended base station, i.e., the base station in the adjacent cell. Depending on the relative power level of two same-carrier frequency signals received at the unintended base station, it may not be able to properly differentiate a signal transmitted from within its cell from the signal transmitted from the adjacent cell. There is required a mechanism for reducing the subscriber unit antenna's apparent field of view, which can have a marked effect on the operation of the forward link (base to subscriber) by reducing the number of interfering transmissions received at a base station. A similar improvement in the reverse link antenna pattern allows a reduction in the desired transmitted signal power, to achieve a receive signal quality.

BRIEF SUMMARY OF THE INVENTION

An antenna according to the present invention comprises an active element and a plurality of passive dipoles spaced apart from and circumscribing the active element. A controller selectably controls the passive dipoles to operate in a reflective or a directive mode.

More particularly, the antenna comprises a ground plane, an active antenna element adjacent the ground plane, and a plurality of passive antenna elements adjacent the ground plane and spaced apart from the active antenna element. A plurality of first parasitic gratings is adjacent the ground plane and is spaced apart from the active antenna element. Each first parasitic grating may be between two adjacent passive antenna elements.

The antenna further comprises a controller for selectably controlling the plurality of passive antenna elements for operating in a reflective mode or a directive mode. The controller may comprise for each respective passive antenna element at least one impedance element connected to the ground plane, and a switch adjacent the ground plane. The switch is for connecting the at least one impedance element to the passive antenna element so that the passive antenna element operates in the reflective or directive mode.

The antenna may further comprise a plurality of second parasitic gratings adjacent the ground plane and spaced apart from the active antenna element. Each second parasitic grating may be radially aligned with a passive antenna element. The plurality of first parasitic gratings may be arranged in one or more concentric circles from the active antenna element. In addition, the plurality of first parasitic gratings may be vertically oriented.

Another embodiment of the present invention is directed to an antenna comprising a ground plane, an active antenna element adjacent the ground plane, and a plurality of passive antenna elements spaced apart from the active antenna element. Each passive antenna element may comprise an upper segment adjacent the ground plane and a lower segment connected to the ground plane.

The antenna further comprises a controller for selectably controlling the plurality of passive antenna elements for operating in a reflective mode or a directive mode. The controller may comprise for each respective passive antenna element a first load, a second load and a switch. The switch is for connecting the first load between the upper and lower segments so that the passive antenna element operates in the reflective mode, and for connecting the second load between the upper and lower segments so that the passive antenna element operates in the directive mode. The first and second loads may comprise an inductive load and a capacitive load, for example.

BRIEF DESCRIPTION OF THE DRAWINGS

The foregoing and other features and advantages of the invention will be apparent from the following description of the preferred embodiments of the invention, as illustrated in the accompanying drawings in which like referenced characters refer to the same parts throughout the different figures. The drawings are not necessarily to scale, emphasis instead being placed upon illustrating the principles of the invention.

DETAILED DESCRIPTION OF THE INVENTION

Figure 1:
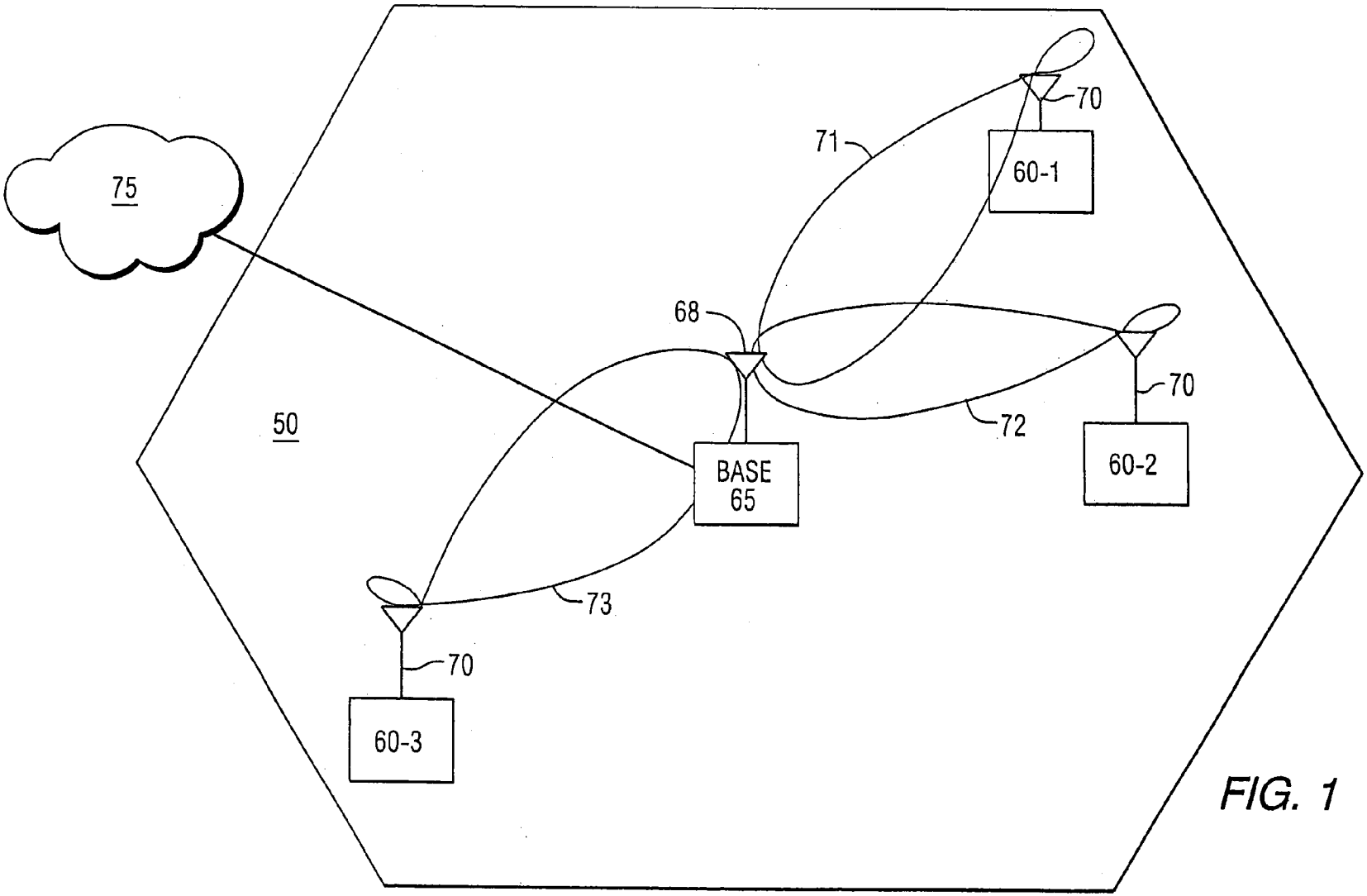
FIG. 1 illustrates a cell of a CDMA cellular communication system.

FIG. 1 illustrates one cell 50 of a typical CDMA cellular communication system. The cell 50 represents a geographical area in which mobile subscriber units 60-1 through 60-3 communicate with a centrally located base station 65. Each subscriber unit 60 is equipped with an antenna 70 configured according to the present invention. The subscriber units 60 are provided with wireless data and/or voice services by the system operator and can connect devices such as, for example, laptop computers, portable computers, personal digital assistants (PDAs) or the like through base station 65 (including the antenna 68) to a network 75, comprising the public switched telephone network (PSTN), a packet switched computer network, such as the Internet, a public data network or a private intranet. The base station 65 communicates with the network 75 over any number of different available communications protocols such as primary rate ISDN, or other LAPD based protocols such as IS-634 or V5.2, or even TCP/IP if the network 75 is a packet based Ethernet network such as the Internet. The subscriber units 60 may be mobile in nature and may travel from one location to another while communicating with the base station 65. As the subscriber units leave one cell and enters another, the communications link is handed off from the base station of the exiting cell to the base station of the entering cell.

FIG. 1 illustrates one base station 65 and three mobile subscriber units 60 in a cell 50 by way of example only and for ease of description of the invention. The invention is applicable to systems in which there are typically many more subscriber units communicating with one or more base stations in an individual cell, such as the cell 50.

It is also to be understood by those skilled in the art that FIG. 1 represents a standard cellular type communications system employing signaling schemes such as a CDMA, TDMA, GSM or others, in which the radio channels are assigned to carry data and/or voice between the base stations 65 and subscriber units 60. In one embodiment, FIG. 1 is a CDMA like system, using code division multiplexing principles such as those defined in the IS-95B standards for the air interface. It is further understood by those skilled in the art that the various embodiments of the present invention can be employed in other wireless communications systems operating under various communications protocols, including the IEEE 802.11 standards and the Bluetooth standards.

In one embodiment of the cell-based system, the mobile subscriber units 60 employ an antenna 70 that provides directional reception of forward link radio signals transmitted from the base station 65, as well as directional transmission of reverse link signals (via a process called beam forming) from the mobile subscriber units 60 to the base station 65. This concept is illustrated in FIG. 1 by the example beam patterns 71 through 73 that extend outwardly from each mobile subscriber unit 60 more or less in a direction for best propagation toward the base station 65. By directing transmission more or less toward the base station 65, and directively receiving signals originating more or less from the location of the base station 65, the antenna apparatus 70 reduces the effects of intercell interference and multipath fading for the mobile subscriber units 60. Moreover, since the antenna beam patterns 71, 72 and 73 extend outward in the direction of the base station 65 but are attenuated in most other directions, less power is required for transmission of effective communications signals from the mobile subscriber units 60-1, 60-2 and 60-3 to the base station 65. Thus the antennas 70 provide increased gain when compared with an isotropic radiator.

Figure 2:
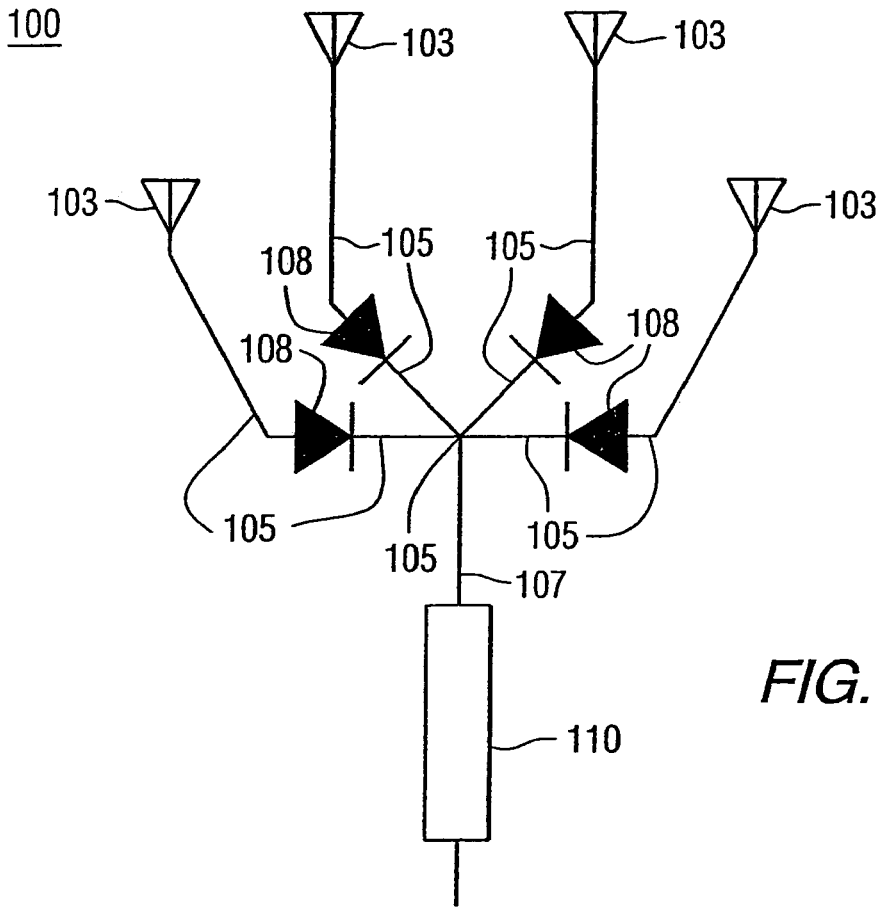
FIGS. 2 and 3 illustrate antenna structures for increasing antenna gain to which the teachings of the present invention can be applied.

One antenna array embodiment providing a directive beam pattern and further to which the teachings of the present invention can be applied, is illustrated in FIG. 2. The FIG. 2 antenna array 100 comprises a four-element circular array provided with four antenna elements 103. A single-path network feeds each of the antenna elements 103. The network comprises four fifty-ohm transmission lines 105 meeting at a junction 106, with a 25-ohm transmission line 107. Each of the antenna feed lines 105 has a switch 108 interposed along the feed line. In FIG. 1, each switch 108 is represented by a diode, although those skilled in the art recognize that other switching elements can be employed in lieu of the diodes, including the use of a single-pole-double-throw (SPDT) switch. In any case, each of the antenna elements 103 is independently controlled by its respective switch 108. A 35-ohm quarter-wave transformer 110 matches the 25-ohm transmission line 107 to the 50-ohm transmission lines 105.

In operation, typically two adjacent antenna elements 103 are connected to the transmission lines 105 via closing of the associated switches 108. Those elements 103 serve as active elements, while the remaining two elements 103 for which the switches 108 are open, serve as reflectors. Thus any adjacent pair of the switches 108 can be closed to create the desired antenna beam pattern. The antenna array 100 can also be scanned by successively opening and closing the adjacent pairs of switches 108, changing the active elements of the antenna array 100 to effectuate the beam pattern movement. In another embodiment of the antenna array 100, it is also possible to activate only one element, in which case the transition line 107 has a 50-ohm characteristic impedance and the quarter-wave transformer 110 is unnecessary.

Figure 3:
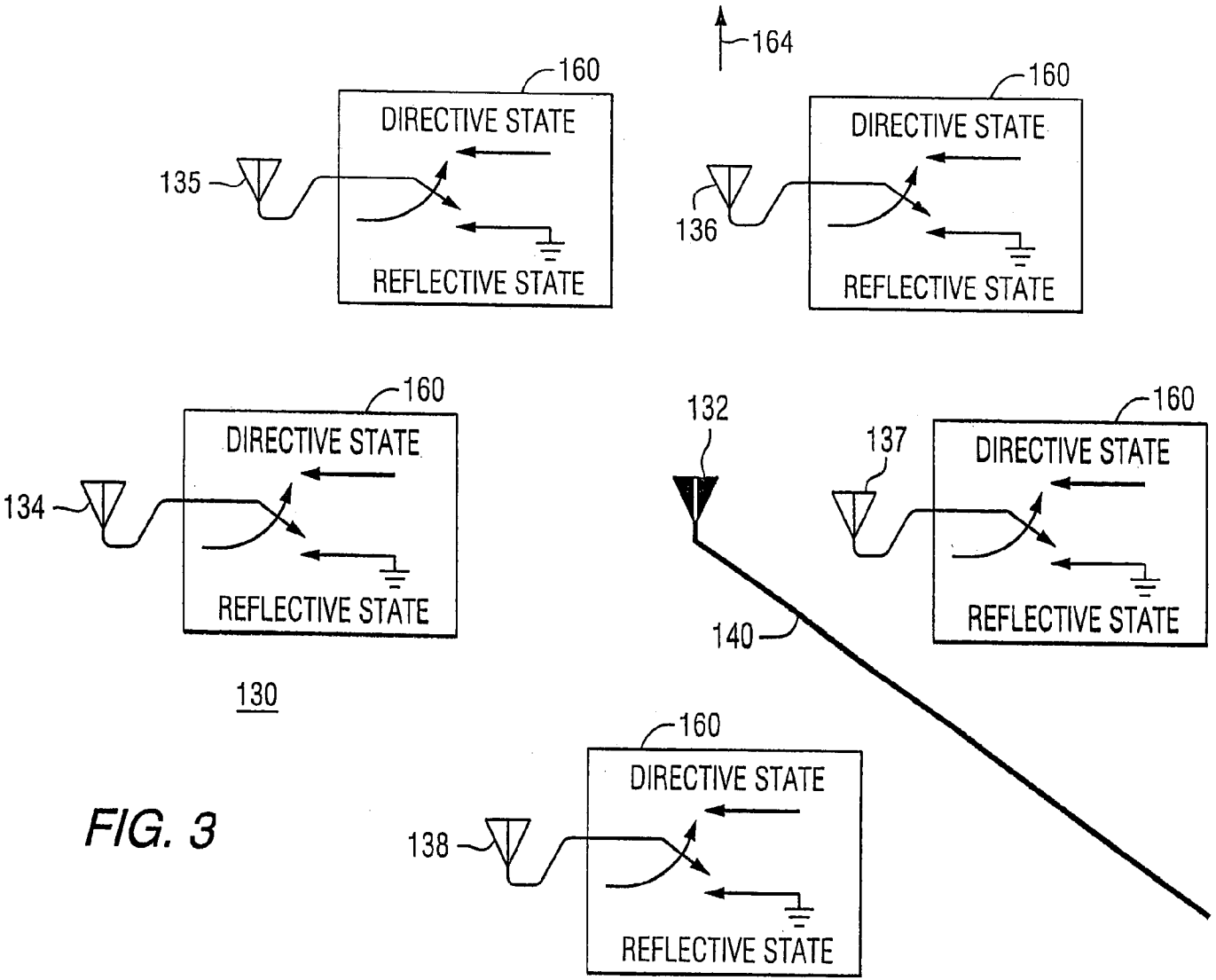

Another antenna design that presents an inexpensive, electrically small, low loss, low cost, medium directivity, electronically scanable antenna array is illustrated in FIG. 3. This antenna array 130 includes a single excited antenna element surrounded by electronically tunable passive elements that serve as directors or reflectors as desired. The exemplary antenna array 130 includes a single central active element 132 surrounded by five passive reflector-directors 134 through 138. The reflector-directors 134–138 are also referred to as passive elements. In one embodiment, the active element 132 and the passive elements 134 through 138 are dipole antennas. As shown, the active element 132 is electrically connected to a fifty-ohm transmission line 140. Each passive element 134 through 138 is attached to a single-pole double throw (SPDT) switch 160. The position of the switch 160 places each of the passive elements 134 through 138 in either a directive or a reflective state. When in a directive state, the antenna element is virtually invisible to the radio frequency signal and therefore directs the radio frequency energy in the forward direction. In the reflective state the radio frequency energy is returned in the direction of the source.

Electronic scanning is implemented through the use of the SPDT switches 160. Each switch 160 couples its respective passive element into one of two separate open or short-circuited transmission line stubs. The length of each transmission line stub is predetermined to generate the necessary reactive impedance for the passive elements 134 through 138, such that the directive or reflective state is achieved. The reactive impedance can also be realized through the use of an application-specific integrated circuit or a lumped reactive load.

When in use, the antenna array 130 provides a fixed beam directive pattern in the direction identified by the arrowhead 164 by placing the passive elements 134, 137 and 138 in the reflective state while the passive elements 135 and 136 are switched to the directive state. Scanning of the beam is accomplished by progressively opening and closing adjacent switches 160 in the circle formed by the passive elements 134 through 138. An omnidirectional mode is achieved when all of the passive elements 134 through 138 are placed in the directive state.

As will be appreciated by those skilled in the art, the antenna array 130 has N operating directive modes, where N is the number of passive elements. The fundamental array mode requires switching all of the N passive elements to the directive state to achieve an omnidirectional far-field pattern. Progressively increasing directivity can be achieved by switching from one to approximately half the number of passive elements into the reflective state, while the remaining elements are directive.

Figure 4:
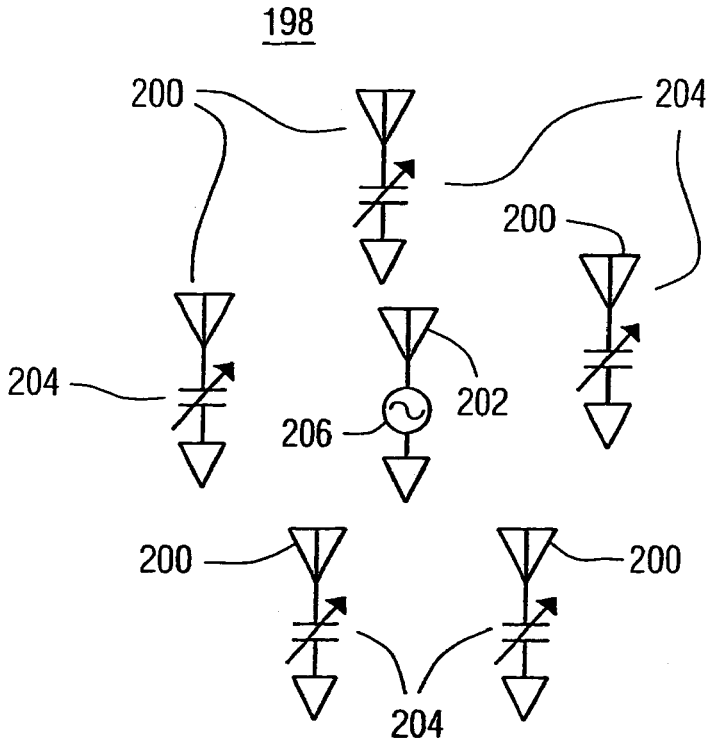
FIG. 4 illustrates an antenna array wherein each antenna has a variable reactive load.

FIG. 4 illustrates an antenna array 198 comprising six vertical monopoles 200 arranged at an approximately equal radius (and having approximately equal angular spacing there between), from a center element 202. The center element is the active element, in the transmitting mode, as indicated by the alternating input signal referred to with reference character 206. According to the antenna reciprocity theorem, the active element 202 functions in a reciprocal manner for signals transmitted to the antenna array 198. The passive elements 200 shape the radiation pattern from (or to) the active element 202 by selectively providing reflective or directive properties at their respective location. The reflective/directive properties or a combination of both is determined by the setting of the variable reactance element 204 associated with each of the passive elements 200. When the passive elements 200 are configured to serve as directors, the radiation transmitted by the active element 202 (or received by the active element 202 in the receive mode) passes through the ring of passive elements 200 to form an omnidirectional antenna beam pattern. When the passive elements 200 are configured in the reflective mode, the radio frequency energy transmitted from the active element 202 is reflected back toward the center of the antenna ring. Generally, it is known that changing the resonant length causes an antenna element to become reflective when the element is longer than the resonant length, (wherein the resonant length is defined $\lambda/2$ or $\lambda/4$ if a ground plane is present below the antenna element) or directive/transparent when the element is shorter than the resonant length. A continuous distribution of reflectors among the passive elements 200 collimates the radiation pattern in the direction of those elements configured as directors.

As shown in FIG. 4, each of the passive elements 200 and the active element 202 are oriented for vertical polarization of the transmitted or received signal. It is known to those skilled in the art that horizontal placement of the antenna elements results in horizontal signal polarization. For horizontal polarization, the active element 202 is replaced by a loop or annular ring antenna and the passive elements 202 are replaced by horizontal dipole antennas.

Figure 5:
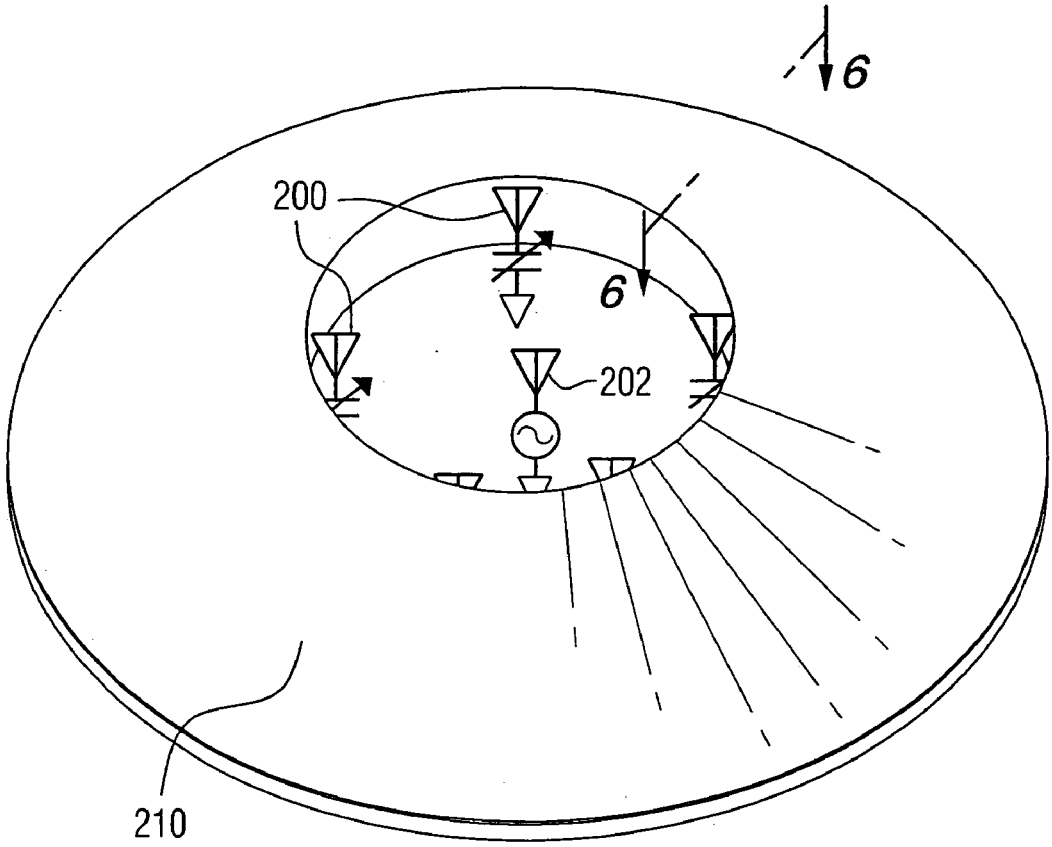
FIGS. 5 and 6 illustrate the use of a dielectric ring in conjunction with the present invention.

According to the teachings of the present invention, the energy passing through the directive configured passive elements 200 can be further shaped into a more directive antenna beam. As shown in FIG. 5, the beam is shaped by placement of an annular dielectric substrate 210 around the antenna array 198. The dielectric substrate is in the shape of a ring with an outer band defining an interior aperture, with the passive elements 200 and the active element 202 disposed within the interior aperture. The dielectric substrate 210 is a slow wave structure having a lower propagation constant than air. As a result, the portion of the transmitted wave (or the received wave in the receive mode) that contacts the dielectric substrate 210 is guided and slowed relative to the free space portion of the wave. As a result, the radiation pattern in the elevation direction narrows (the elevation energy is attenuated) and the radiation is focused toward the azimuth direction. Thus the antenna beam pattern gain is increased. The slow wave structure essentially guides the power or radiated energy along the dielectric slab to form a more directive beam. In one embodiment, the radius of the dielectric substrate 210 is at least a half wavelength. As is known to those skilled in the art, a slow wave structure can take many forms, including a dielectric slab, a corrugated conducting surface, conductive gratings or any combination thereof.

Typically, the variable reactance elements 204 are tuned to optimize operation of the passive elements 200 with the dielectric substrate 210. For a given operational frequency, once the optimum distance between the passive elements 200 and the circumference of the interior aperture of the dielectric substrate 210 has been established, this distance remains unchanged during operation at the given frequency.

Figure 6:
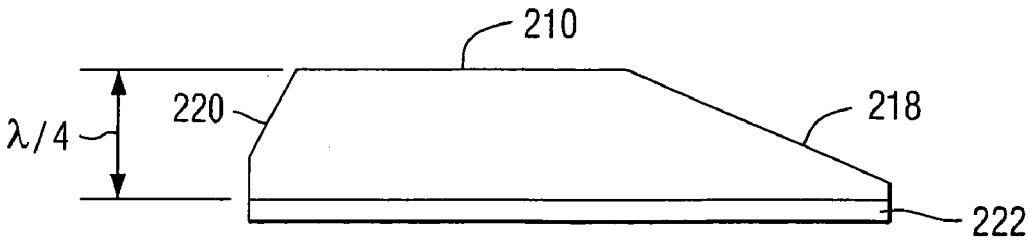

FIG. 6 illustrates the dielectric substrate 210 along cross section 6—6 of FIG. 5. The dielectric substrate 210 includes two tapered edges 218 and 220. A ground plane 222 below the dielectric substrate 210 can also be seen in this view. Both of these tapered edges 218 and 220 edges ease the transition from air to substrate or vice versa. Abrupt transitions cause reflections of the incident wave, which, in this situation, reduces the effect of the slow wave structure.

Although the tapers 218 and 220 are shown of unequal length, those skilled in the art will recognize that a longer taper provides a more advantageous transition between the free space propagation constant and the dielectric propagation constant. The taper length is also dependent upon the space available for the dielectric slab 210. Ideally, the tapers should be long if sufficient space is available for the dielectric substrate 210.

In one embodiment, the height of the dielectric substrate 210 is the wavelength of the received or transmitted signal divided by four (i.e., $\lambda/4$). In an embodiment where the ground plane 222 is not present, the height of the dielectric slab 210 is $\lambda/2$. The wavelength $\lambda$ when considered in conjunction with the dielectric substrate 210, is the wavelength in the dielectric, which is always less than the free space wavelength. The antenna directivity is a monotonic function of the dielectric substrate radius. A longer dielectric substrate 210 provides a gradual transition over which the radio frequency signal passes from the dielectric substrate 210 into free space (and vice versa for a received wave). This allows the wave to maintain collimation, increasing the antenna array directivity when the wave exits the dielectric substrate 210. As known by those skilled in the art, generally, the antenna directivity is calculated in the far field where the wave front is substantially planar.

In one embodiment, the passive elements 200, the active element 202 and the dielectric substrate 210 are mounted on a platform or within a housing for placement on a work surface. Such a configuration can be used with a laptop computer, for example, to access the Internet via a CDMA wireless system or to access a wireless access point, with the passive elements 200 and the active element 202 fed and controlled by a wireless communications devices in the laptop. In lieu of placing the antenna elements 200 and 202 and the dielectric substrate 210 in a separate package, they can also be integrated into a surface of the laptop computer such that the passive elements 200 and the active element 202 extend vertically above that surface. The dielectric substrate 210 can be either integrated within that laptop surface or can be formed as a separate component for setting upon the surface in such a way so as to surround the passive elements 200. When integrated into the surface, the passive elements 200 and the active element 202 can be foldably disposed toward the surface when in a folded state and deployed into a vertical state for operation. Once the passive elements 200 and the active element 202 are vertically oriented, the separate dielectric slab 210 can be fitted around the passive elements 200.

The dielectric substrate 210 can be fabricated using any low loss dielectric material, including polystyrene, alumina, polyethylene or an artificial dielectric. As is known by those skilled in the art, an artificial dielectric is a volume filled with hollow metal spheres that are isolated from each other.

Figure 7:
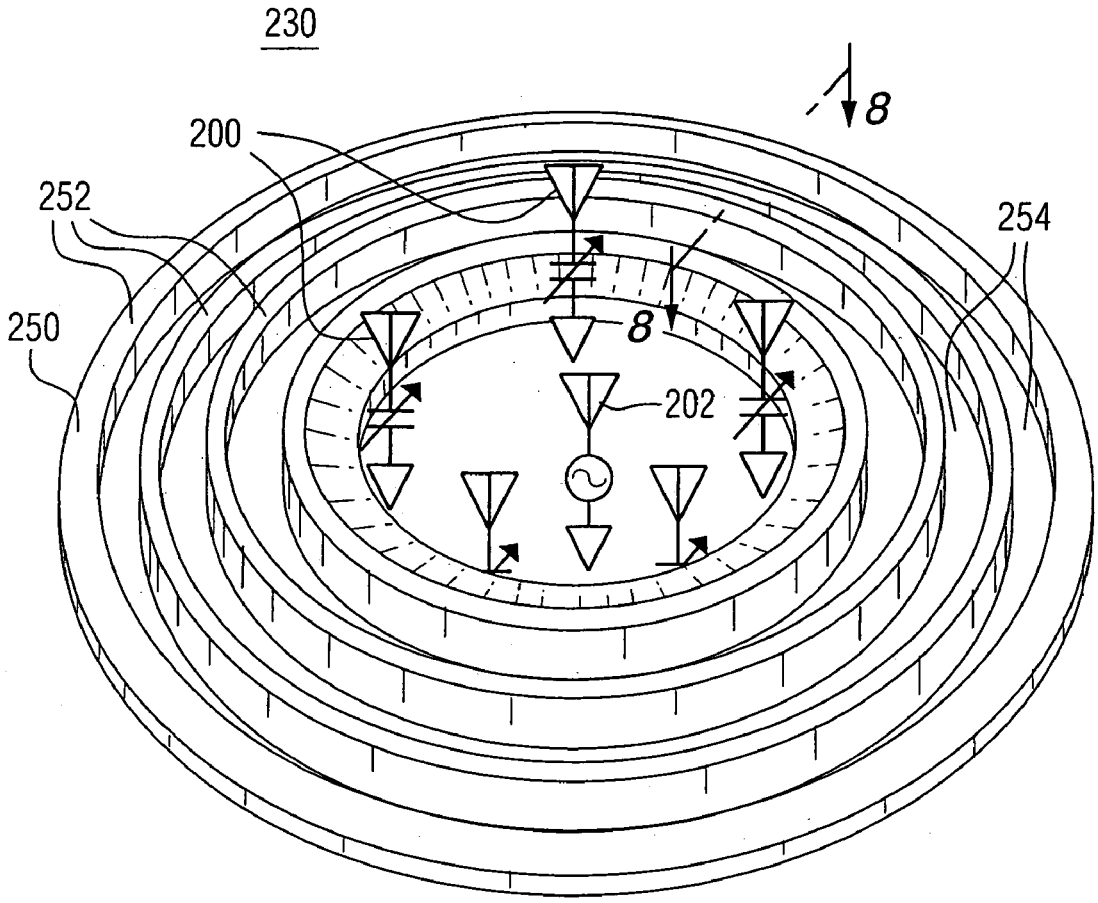
FIGS. 7 and 8 illustrate a corrugated ground plane for producing a more directive antenna beam in accordance with the teachings of the present invention.
Figure 8:
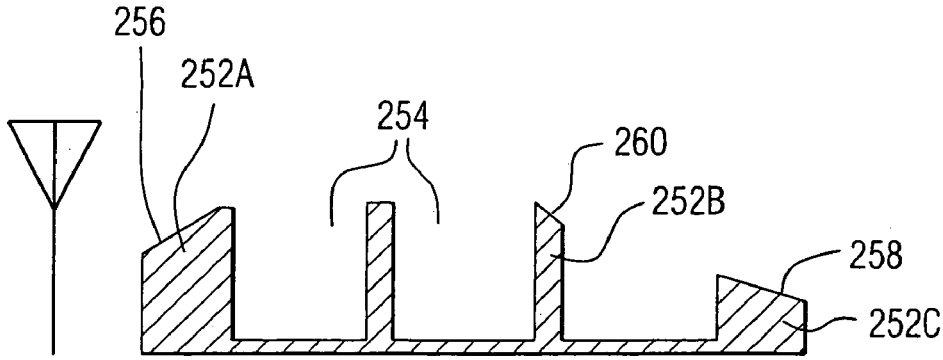

FIG. 7 illustrates an antenna array 230, including a corrugated metal disk 250 surrounding the passive antenna elements 200. The corrugated metal disk 250, which offers similar gain-improving functionality as the dielectric substrate 210 in FIG. 5, comprises a plurality of circumferential mesas 252 defining grooves 254 there between. FIG. 8 is a view through section 8—8 of FIG. 7. Note that the innermost mesa 252A includes a tapered surface 256. Also, the outermost mesas 252B and 252C include tapered surfaces 258 and 260, respectively. As in the FIG. 5 embodiment, the tapers 256 and 258 provide a transition region between free space and the propagation constant presented by the corrugated metal disk 250. Like the dielectric substrate 210, the corrugated metal disk 250 serves as a slow wave structure because the grooves 254 are approximately a quarter-wavelength deep and therefore present an impedance to the traveling radio frequency signal that approximates an open, i.e., a quarter-wavelength in free space. However, because the notches do not present precisely an open circuit, the impedance causes bending of the traveling wave in a manner similar to the bending caused by the dielectric substrate 210 of FIG. 5. If the grooves 254 were to provide a perfect open, no radio frequency energy would be trapped by the groove and there would be no bending of the wave. The key to successful utilization of the FIG. 7 embodiment is the trapping of the radio frequency wave. When the grooves 254 are shallow, they release the wave and thus the contouring (i.e., the location of the mesas and grooves) controls the location and degree to which the wave is allowed to radiate to form a collimated wave front. For example, if the grooves were radially oriented, the wave would simply travel along the grooves and could not be controlled. Although the FIGS. 7 and 8 embodiments illustrate only three grooves or notches, it is known by those skilled in the art that additional grooves or notches can be provided to further control the traveling radio frequency wave and improve the directivity of the antenna in the azimuth direction.

Figure 9:
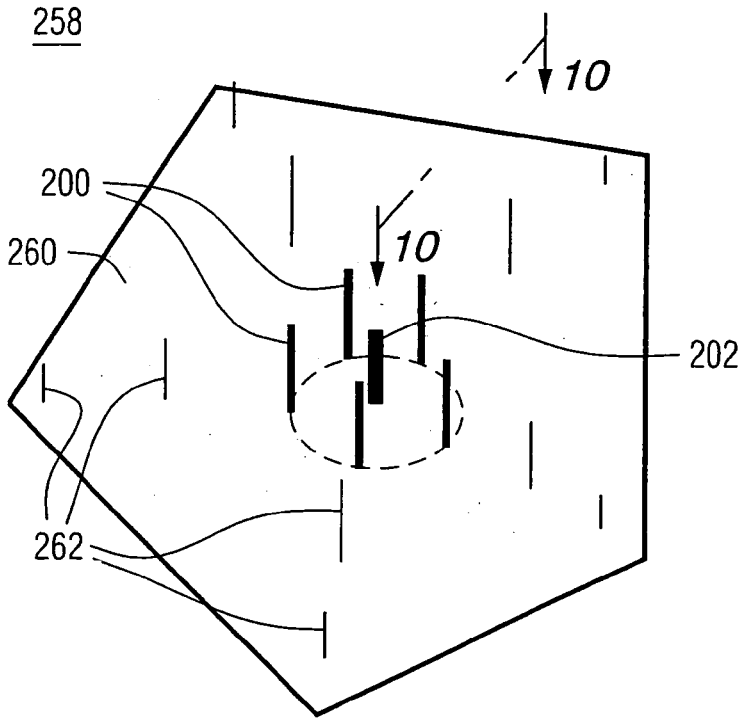
FIGS. 9, 10, 11, 12, 13 and 14 illustrate an embodiment of the present invention including vertical gratings.

FIG. 9 illustrates an antenna array 258 representing another embodiment of the present invention, including a ground plane 260, the previously discussed active element 202 and the passive elements 200. Additionally, FIG. 9 illustrates a plurality of parasitic conductive gratings 262. In the embodiment of FIG. 9, the parasitic conductive gratings 262 are shown as spaced apart from and along the same radial lines as the passive elements 200. In a sense, the antenna array 258 of FIG. 9 is a special case of the antenna array 230 of FIG. 7. The height of the circumferential mesas 252 is represented by the position of the parasitic conductive gratings 262. The taper of the outer mesas 252B and 252C in FIG. 8 is repeated by tapering the parasitic conductive gratings 262 in the direction away from the center element 202.

Figure 10:
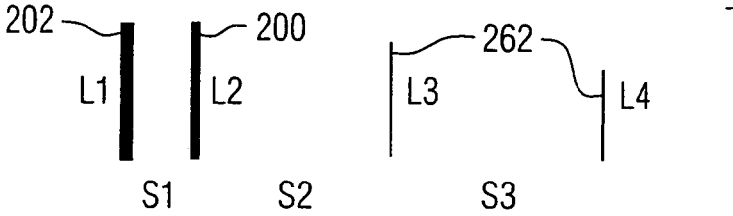

FIG. 10 illustrates the antenna array 258 in cross section along the lines 10—10. Exemplary lengths for the passive elements 200 and the active element 202 are also shown in FIG. 10. Further, exemplary height and spacing between the parasitic conductive gratings 262 at 1.9 GHz are also set forth. Generally, the spacing is about 0.9X to 0.28. The spacing between the active element 202, the passive elements 200, and the plurality of parasitic conductive gratings 262 are generally tied to the height of each element. If the passive elements 200 and the plurality of parasitic conductive gratings 262 are a resonant length, the element simply resonates and thereby retains the received energy. Some energy may spill over to neighboring elements. If the element is shorter than a resonant length, then the impedance of the element causes it to act as a forward scatterer due to the imparted phase advance. Scattering is the process by which a radiating wave strikes an obstacle, and then re-radiates in all directions. If the scattering is predominant in the forward direction of the traveling wave, then the scattering is referred to as forward scattering. If the element is longer than a resonant length, the resulting phase retardation interacts with the original traveling wave thereby reducing or even canceling the forward traveling radiation. As a result, the energy is scattered backwards. That is, the element acts as a reflector. In the FIG. 9 embodiment, the plurality of parasitic conductive gratings 262 can be either shorted to the ground plane 260 or adjustably reactively loaded, where the loading effectively adjusts the effective length of any one of the plurality of parasitic conductive gratings 262 causing the parasitic conductive grating 262 to have a length equal to, less than or greater than the resonant length, with the resulting directive or reflective effects as discussed above. Providing this controllable reactive feature provides the ability to vary the degree of directivity or beam pattern width as desired.

It should also be noted that in the FIG. 9 embodiment the ground plane 260 is pentagonal in shape. In another embodiment, the ground plane can be circular. In one embodiment, the number of facets in the ground plane 260 is equal to the number of passive elements. As in the embodiments of FIGS. 5 and 7, the plurality of gratings or parasitic conductive elements 262 serve to slow the radio frequency wave and thus improve the directivity in the azimuth direction. Adding more gratings causes further reductions in the RF energy in the elevation direction. Note that the beam pattern produced by the antenna array 258 includes five individual and highly directive lobes when each of the passive elements 200 is placed in the directive state. When two adjacent passive elements 200 are placed in a directive state, the highly directive lobe is formed in a direction between the two directive elements, due to the addition of the energy of each lobe. When all passive elements 200 are placed in a directive state simultaneously, an omni-directional pancake pattern (i.e., relatively close to the plane of the ground plane 260) is created.

As compared with the grooves 254 of FIG. 7, the parasitic conductive gratings 262 of FIG. 9 have sharper resonance peaks and therefore are very efficient in slowing the traveling RF wave. However, as also discussed in conjunction with FIG. 7, the parasitic conductive gratings 262 are not spaced at precisely the resonant frequency. Instead, a residual resonance is created that causes the slowing effect in the radio frequency signal.

Figure 11:
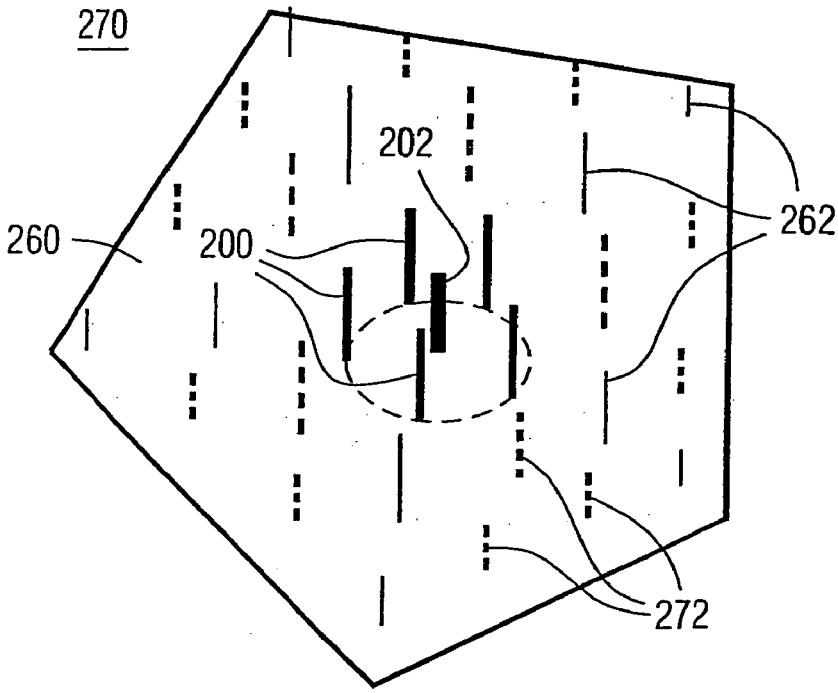

The antenna array 270 of FIG. 11 includes the elements of FIG. 9, with the addition of a plurality of interstitial parasitic elements 272 between the parasitic conductive gratings 262, to further guide and shape the radiation pattern. The interstitial parasitic elements 272 are shorted to the ground plane 260 and provide additional refinement of the beam pattern. The interstitial parasitic elements 272 are placed experimentally to afford one or more of the following objectives: reducing the ripple in the omnidirectional pattern, adding intermediate high-gain beam positions when the array is steered through the resonant characteristic of the parasitic elements 200, reducing undesirable side lobes and improving the front to back power ratio.

In one embodiment, an antenna constructed according to the teachings of FIG. 11, has a peak directivity of 8.5 to 9.5 dBi over a bandwidth of about thirty percent. By electronically controlling the reactance of each passive element 200, this high-gain antenna beam can also be steered. When all of the passive elements 200 are in the directive mode, an omnidirectional beam substantially in the azimuth plane is formed. In the omnidirectional mode, the peak directivity was measured at 5.6 to 7.1 (dBi) over the same frequency band as the directive mode. Thus, the FIG. 11 embodiment provides both a high-gain omnidirectional pattern and a high-gain steerable beam pattern. For an antenna operative at 1.92 GHz in one embodiment, the approximate height of the interstitial parasitic elements 272 is 1.5 inches and the distance from the active element 202 to the outer interstitial parasitic elements 272 is approximately 7.6 inches.

Figure 12:
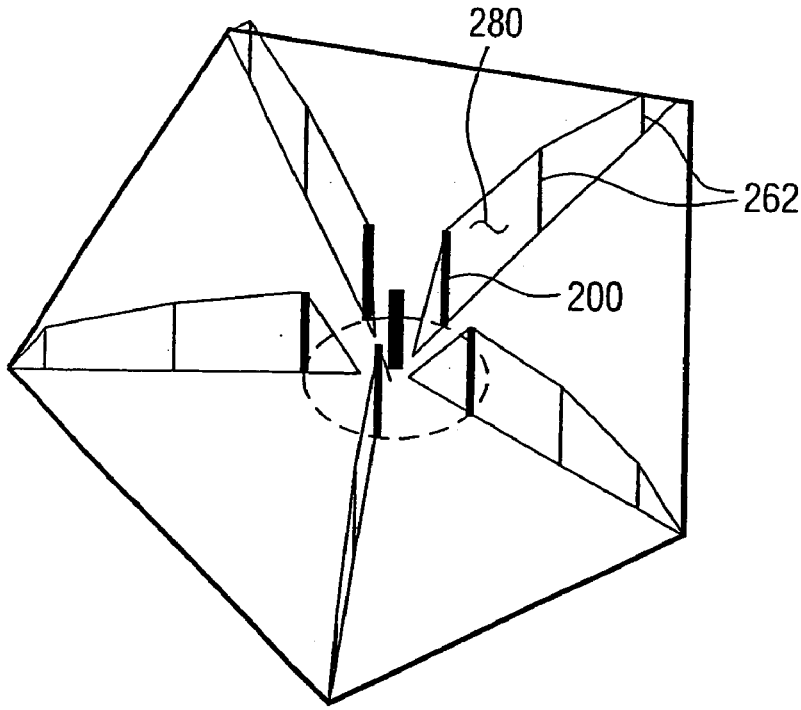

The antenna array of FIG. 12 is derived from FIG. 9, where an axial row of the parasitic conductive gratings 262 and one passive element 200 are integrated into or disposed on a dielectric substrate or printed circuit board 280. Note that in the FIG. 9 embodiment, the passive elements 200 and the parasitic conductive gratings 262 are fabricated individually. The passive elements 200 are separated from the ground plane 260 by an insulating material and conductively connected to the reactance control elements previously discussed. The parasitic conductive gratings 262 are shorted directly to the ground plane 260 or controllably reactively loaded as discussed above. Thus the process of fabricating the FIG. 9 embodiment is time intensive. The FIG. 12 embodiment is therefore especially advantageous because the parasitic conductive gratings 262 and the passive elements 200 are printed on or etched from a dielectric substrate or printed circuit board material. This process of integrating and grouping the various antenna elements as shown, provides additional mechanical strength and improved manufacturing precision with respect to the height and spacing of the elements. Due to the use of a dielectric material between the various antenna elements, the FIG. 12 embodiment can be considered a hybrid between the dielectric substrate embodiment of FIG. 5 and the conductive grating embodiment of FIG. 9. In particular, the dielectric substrate 280 smoothes the discrete resonant properties of the parasitic conductive gratings 262, thereby reducing the formation of gain spikes in the frequency spectrum of the operational bandwidth.

Figure 13:
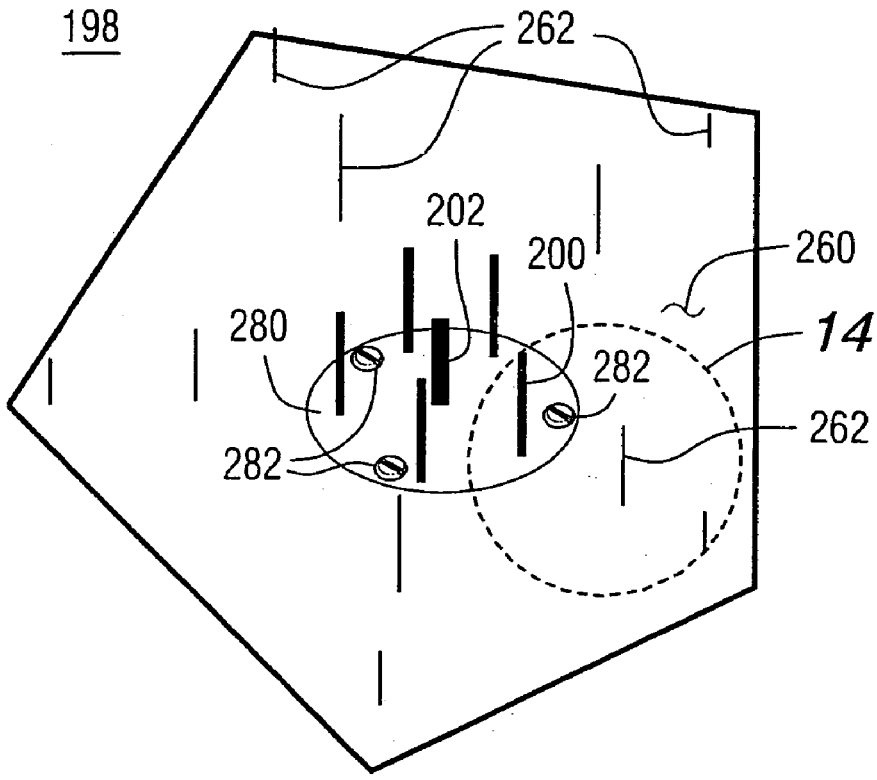
Figure 14:
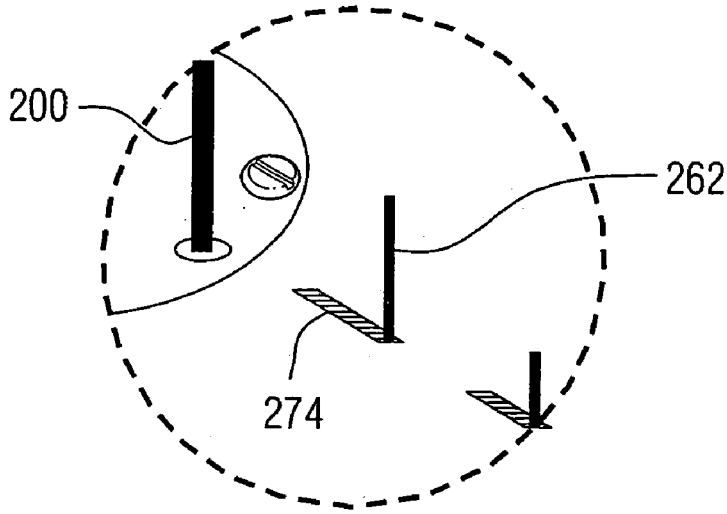

FIG. 13 illustrates another process for fabricating the antenna array 258 of FIG. 9 and the antenna array 270 of FIG. 11. In the FIG. 13 process, the parasitic conductive gratings 262 (and the interstitial parasitic elements 272 in FIG. 11) are stamped from the ground plane 260 and then bent upwardly to form the parasitic conductive gratings 262 (and the interstitial parasitic elements 272 in FIG. 11). This process is illustrated in greater detail in the enlarged view of FIG. 14. In one embodiment, the parasitic conductive gratings 262 and the interstitial parasitic elements 272 are formed by removing a U-shaped region of material from the ground plane 260 such that a deformable joint is formed along an edge of the U-shaped opening where the ground plane material has not been removed. The parasitic conductive gratings 262 and the interstitial parasitic elements 272 are then formed by bending the ground plane material along the joint and out of the plane of the ground plane 260. The void remaining after removing the U-shaped region of the ground plane 260 is referred to by reference character 274. It has been found that the void 274 does not significantly affect the performance of the antenna array 258 (FIG. 9) and 270 (FIG. 11). In the FIG. 13 embodiment, the active element 202 and the passive elements 200 are formed on a separate metallic disc 280, which is attached to the ground plane 260 using screws or other fasteners 282.

Figure 15:
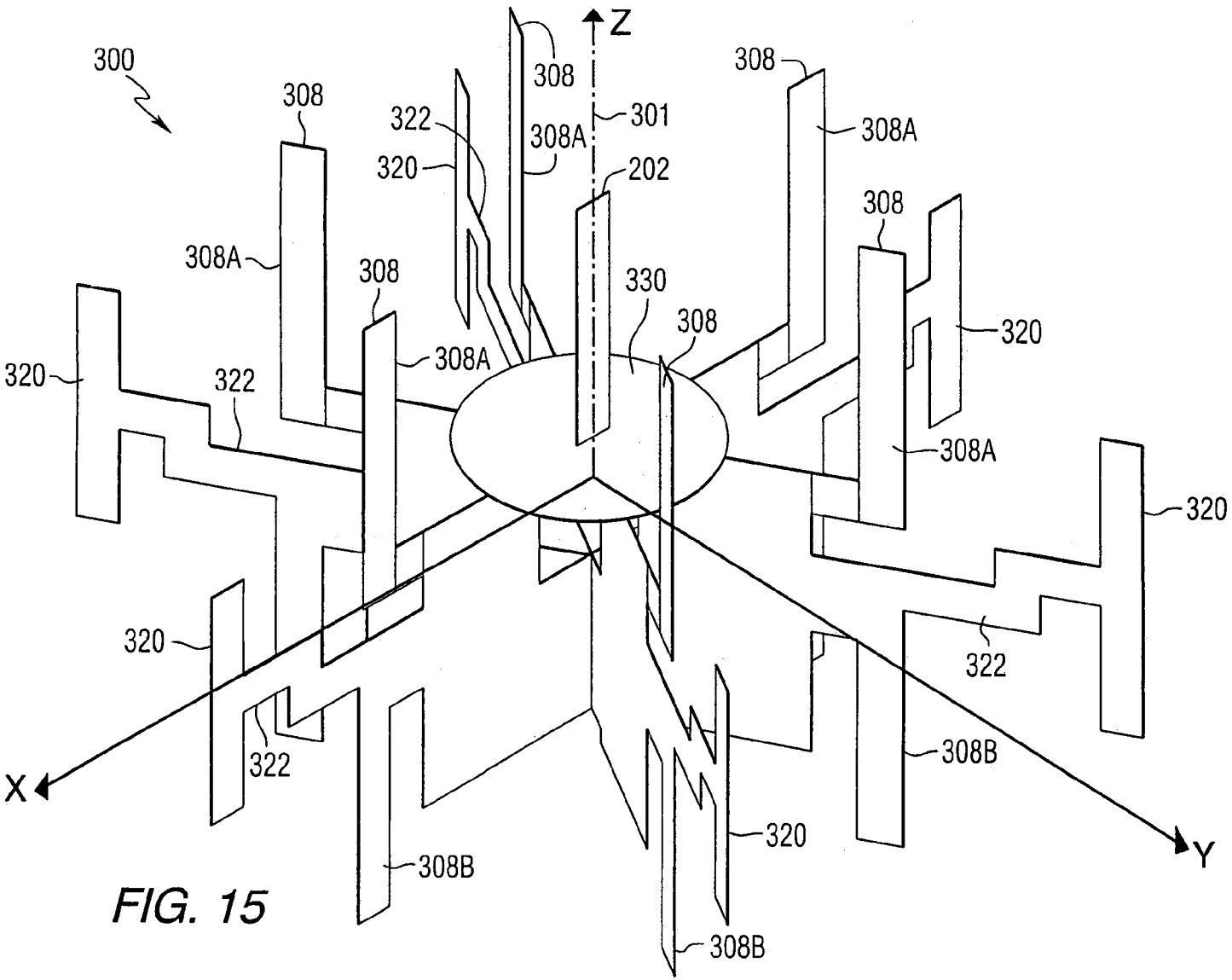
FIG. 15 illustrates another antenna constructed according to the teachings of the present invention.

FIG. 15 is a perspective schematic view of an antenna 300 constructed according to the teachings of another embodiment of the present invention, depicted with reference to a coordinate system 301. The antenna 300 radiates a substantial percentage of the transmitted energy in an XY plane, where the plane is perpendicular to the active element 202 and referred to as the horizon. In the receiving mode the antenna 300 receives a substantial percentage of the received energy in the same XY plane. Generally, the antenna 300 is more directive along the horizon than the embodiments described above. Advantageously, the ground plane of the antenna 300 is smaller than the ground plane of the embodiments described above, thus requiring a smaller space envelope. These features will be discussed further below.

Figure 16:
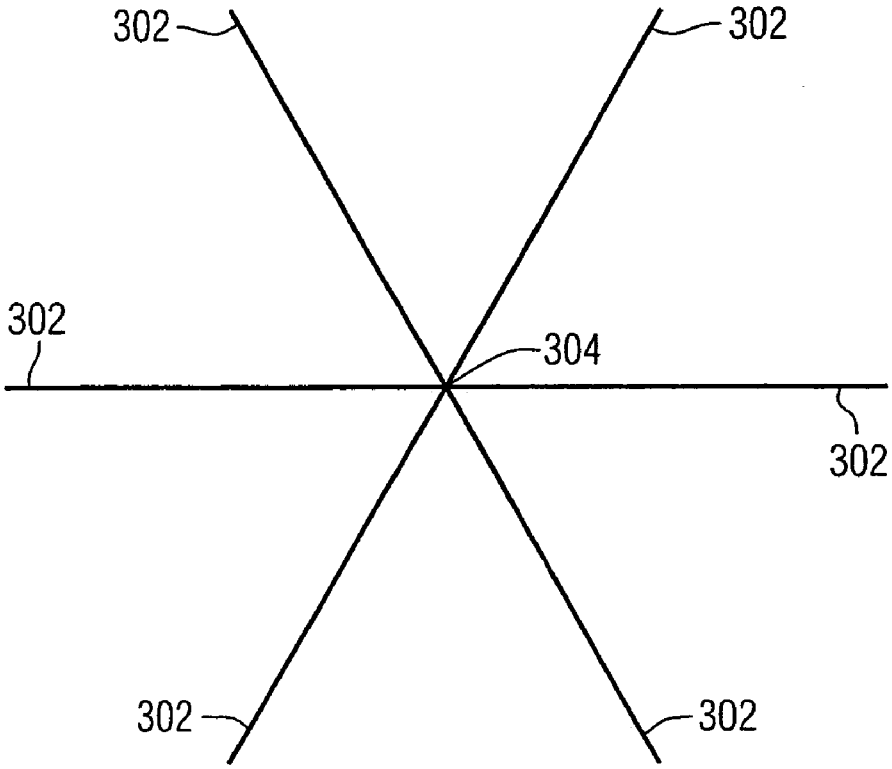
FIG. 16 illustrates a top view of the antenna of FIG. 15.

In the top view of FIG. 16, the antenna 300 comprises a plurality of segments 302 formed from antenna elements that are controllable to reflect or direct the signal emitted from the active element 202 located at a hub 304. In the receiving mode, the antenna elements reflect or direct the received signal. As is known to those skilled in the art, the reflective or directive property is a function of the antenna element effective length as related to the operating frequency. Thus controlling the effective element length, for example, by changing the element's physical length or by the switchable connection of an impedance to the element, achieves the reflective or directive state.

Those skilled in the art recognize that more or fewer segments 302, and thus more or fewer antenna elements, can be employed to produce other desired radiation patterns, including more directive antenna patterns, than achievable with the six segments 302 of FIG. 16. The segments of FIG. 16 are shown as spaced at 60° intervals, but the spacing is also selectable based on the desired radiation pattern.

Figure 17:
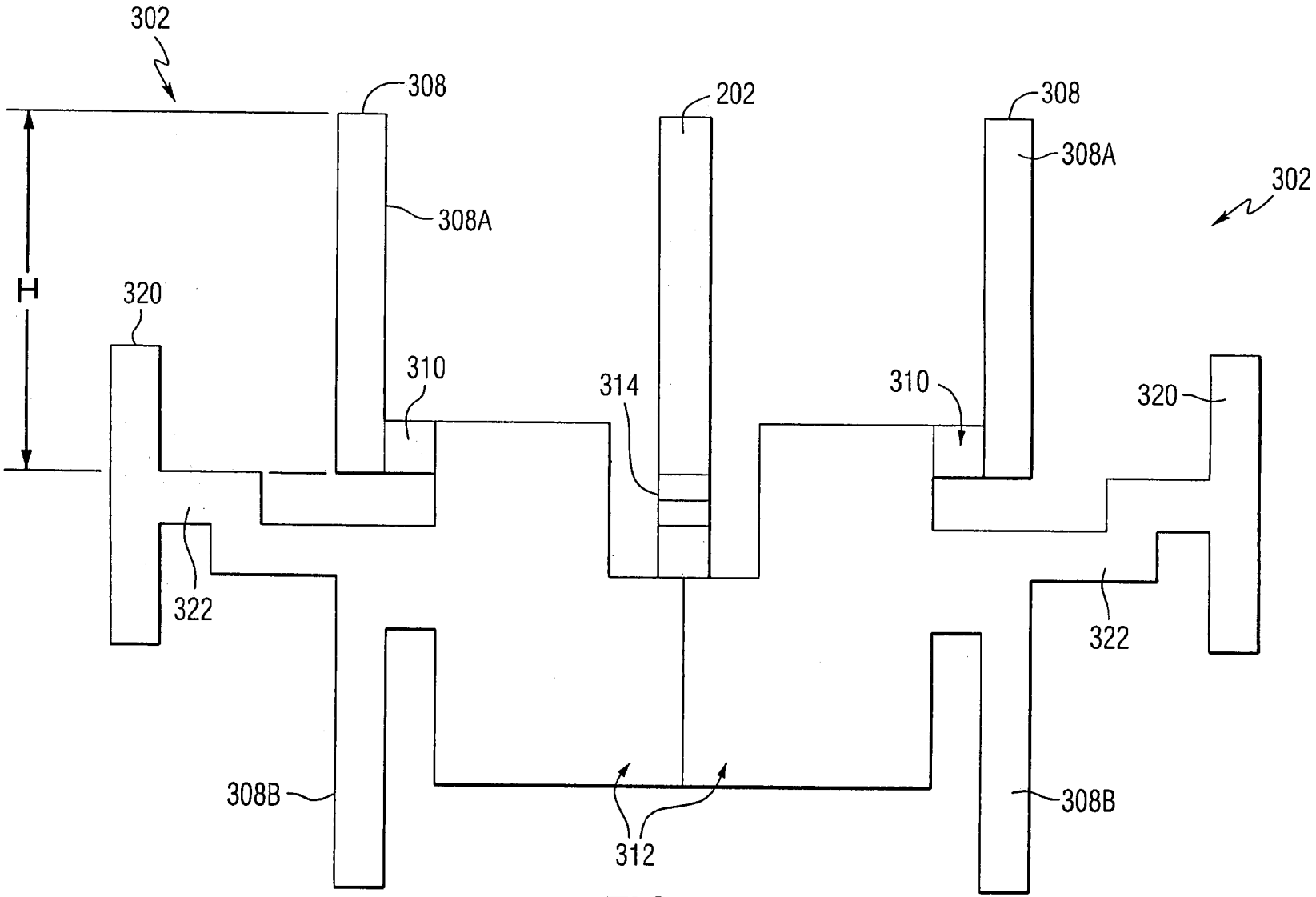
FIG. 17 illustrates a side view of one element of the antenna of FIG. 15.

Two oppositely disposed segments 302 are illustrated in FIG. 17. Each segment 302 comprises a passive dipole 308, further comprising an upper segment 308A and a lower segment 308B. The remaining segments 302, not illustrated in FIG. 17, are similarly constructed. The lower segment 308B is contiguous with a ground plane 312 and is thus formed from a shaped region of the ground plane 312. In one embodiment the ground plane 312 is formed from printed circuit board material e.g., a dielectric substrate with a conductive layer disposed thereon.

By placing each of the passive dipoles 308 in a reflective or a directive state, the antenna beam can be formed in a specific azimuth direction relative to the active element 202. Beam scanning is accomplished by progressively placing each of the passive dipoles 308 into a directive/reflective state. An omnidirectional radiation pattern is achieved when all of the passive dipoles are operated in a directive state.

The upper segment 308A operates as a switched parasitic element, similar to the passive elements 200 described above, loaded through a schematically illustrated switch 310 and in conjunction with the lower segment 308B, forms a dipole operative as a director (a forward scattering element) or as a reflector in response to the impedance load applied through the switch 310. A separate controller (not shown) is operative to determine the state of the passive dipole (e.g., reflective or directive) in response to user supplied inputs or in response to known signal detection and analysis techniques for controlling the antenna parameters to provide the highest quality received or transmitted signal. Such techniques conventionally include determining one or more signal metrics of the transmitted or received signal and in response thereto modifying one or more antenna characteristics to improve the transmitted or received signal metric.

The upper segment 308A is fed as a monopole element, and the lower segment 308B is part of a ground structure that mirrors the upper segment 308A. But because the lower segment 308B is grounded, the circuit equivalent of the passive dipole 308 is a monopole over a ground plane. The radiation characteristics of the passive dipole 308 resemble a dipole because the lower segment 308B resonates with the upper segment 308A. Thus the passive dipole is fed as space-feed element, such that the upper and lower segments 308A and 308B intercept the radio frequency wave and reradiate it like a passive dipole. Since the lower segment 308B is a part of the ground plane 312, balanced loading of the dipole element 308 is not necessary and a balun is not required.

The switchable loading can be a simple impedance, yet the passive dipole 308 radiates with symmetry like a conventional dipole. Advantageously, using the passive dipole 308 provides the higher gain of a dipole, and also the symmetry creates radiation toward the horizon, rather than tilted away from the horizon. The impedance loading can be treated as an extension of the upper segment 308A. If the loading is inductive, the effective length of 308A becomes longer, and the reverse is true for a capacitive loading. Inductive loading makes the combination of the upper and the lower segments 308A and 308B operate as a reflector. Conversely, the combination operates as a director in response to capacitive loading.

Figure 18:
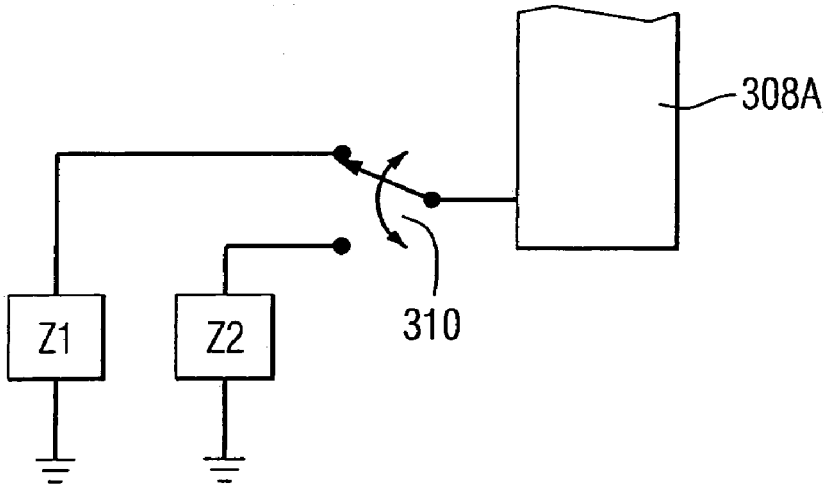
FIG. 18 illustrates a switch for use with the antenna of FIG. 15.

FIG. 18 illustrates the switch 310 and associated components in greater detail. Although illustrated as a mechanical switch, those skilled in the art recognize that the switch 310 can be implemented by a semiconductor device (a metal-oxide semiconductor field effect transistor) or a MEMS (microelectomechanical systems) switch. As illustrated in FIG. 18, the switch 310 switchably connects impedances Z1 and Z2 to the upper segment 308A. Both of the impedances Z1 and Z2 are connected to ground at their respective non-switched terminals. Although the specific values for the impedances Z1 and Z2 are selected based on one or more desired antenna operating parameters (e.g., gain, operating frequency, bandwidth, radiation pattern shape), generally one of the impedance values (Z1 for example) is substantially a capacitive impedance and the other, Z2, is substantially an inductive impedance. The impedances can be provided by lumped or distributed circuit (e.g., a delay line) elements. In other embodiments, the values for Z1 and Z2 can both be capacitive (or both inductive) with one value more capacitive (or inductive) than the other to achieve the desired performance parameters. In other embodiments more than two impedances can be switchably introduced into the upper segment 308A to provide other desired performance characteristics.

In an embodiment where Z1 is substantially capacitive, the associated passive dipole 308 operates as a director when the switch 310 is in a position to connect the upper segment 308A to ground via Z1. When connected to a substantially inductive Z2, the passive dipole 308 operates as a reflector. In either case, current flow induced in the upper segment 308A and the lower segment 308B by the received or transmitted radio frequency signal produces a symmetrical dipole effect, resulting in substantial energy directed proximate the XY plane. Since the passive dipole 308 form more directive horizon beams than a monopole element above a finite ground plane (i.e., the embodiments described above) the antenna 300 exhibits better gain along the horizon than those antenna embodiments described above.

It has been determined, according to the present invention, that optimum antenna gain is achieved when the length H in FIG. 17 is between about 0.25 λ and slightly less than 0.5 λ at the operational frequency. The antenna gain may be reduced for other values of H outside this range.

With continuing reference to FIG. 17, in one embodiment a region 314 comprises a matching element (not shown) for connecting the active element 202 to a source providing the radio frequency signal to be transmitted from the active element 202 and/or to a receiver to which the active element 202 supplies a received signal.

Use of the passive dipoles 308 in lieu of the passive elements 200 and the parasitic conductive gratings 262 as described in the embodiments above, provides improved horizon directivity for the antenna 300, pointing the antenna beam substantially along the horizon. In one example, the improvement is about 4 dB. Since the passive dipoles 308 comprise physically distinct upper and lower segments 308A and 308B, they provide better directive characteristics than the monopole elements (i.e., the passive elements 200 and the parasitic conductive gratings 262) that operate in a dipole mode in conjunction with an image element below the ground plane. Theoretically, an infinite ground plane produces a perfect image element. In practice, the ground plane 260 (see FIG. 9, for example) is finite and thus the image elements are not ideal, resulting in reduced directivity in the direction of the horizon. Use of the passive dipoles 308 improves the directivity of the antenna 300.

Returning to FIG. 15, a parasitic directing element 320 (also referred to as a short-circuited dipole) is disposed in substantially the same vertical plane as each dipole element 308 and connected to the ground plane 312 via a conductive arm 322. The parasitic directing elements 320, which are typically shorter than a half wavelength at the operating frequency of the antenna 300, operate as forward scattering elements, directing the transmitted signal toward the horizon. Since the arm 322 is orthogonal to the polarization of the signal transmitted from the active element 202, the arm 322 is not coupled to the signal and thus does not affect antenna operation. Therefore, in another embodiment the arm material comprises a dielectric. The parasitic directing elements 320 are not necessarily required for operation of the antenna 300, but advantageously provide additional directive effects with regard to propagation of the signal proximate the horizon.

In other embodiments an antenna constructed according to the teachings of the present invention comprises more or fewer passive dipoles 308 and parasitic directing elements 320 as determined by the desired radiation pattern. In still another embodiment the number of passive dipoles 308 is not necessarily equal to the number of parasitic directing elements 320.

Advantageously, the lower segment 308B, the ground plane 312 and the parasitic directing elements 320 on one spoke 302 comprise a unitary structure or a unitary shaped ground plane. In another embodiment the elements can be separately formed and connected by conductive wires or solder joints.

With reference to FIG. 15, a ground plane 330 surrounds the active element 202 and is connected to the ground plane 312. Note in the illustrated embodiment the ground plane 330 is advantageously smaller than the ground planes illustrated in the embodiments illustrated above. However the antenna 300 provides improved directivity proximate the XY plane (the horizon) due to the use of the dipole elements 308, rather than relying on image elements as in the antenna 258 of FIG. 9. In another embodiment the ground plane 330 is not required. In yet another embodiment, the ground plane 330 can be shaped to include the function of the ground plane 312.

Both of the ground planes 312 and 330 can be scaled in relation to the operative frequency of the antenna 300. In an embodiment where the ground plane 312 and/or 330 comprises a dielectric substrate and a conductive layer disposed thereon, electronic circuit elements can be mounted on the substrate and operative to control operation of the antenna elements and to feed or receive the radio frequency signal to/from the active element 202. To mount the electronic circuit elements on the substrate, a region of the substrate is isolated from the ground conductor and conductive interconnections are formed on the isolated region by patterning and etching techniques. Such mounting techniques are know in the art. In particular, the switches 310 are disposed on the ground planes 312 and/or 330. Because the electronic circuit elements do not scale to the operational frequency of the antenna 300, a larger surface area than required for the operational frequency may be required for mounting the circuit elements.

Figure 19:
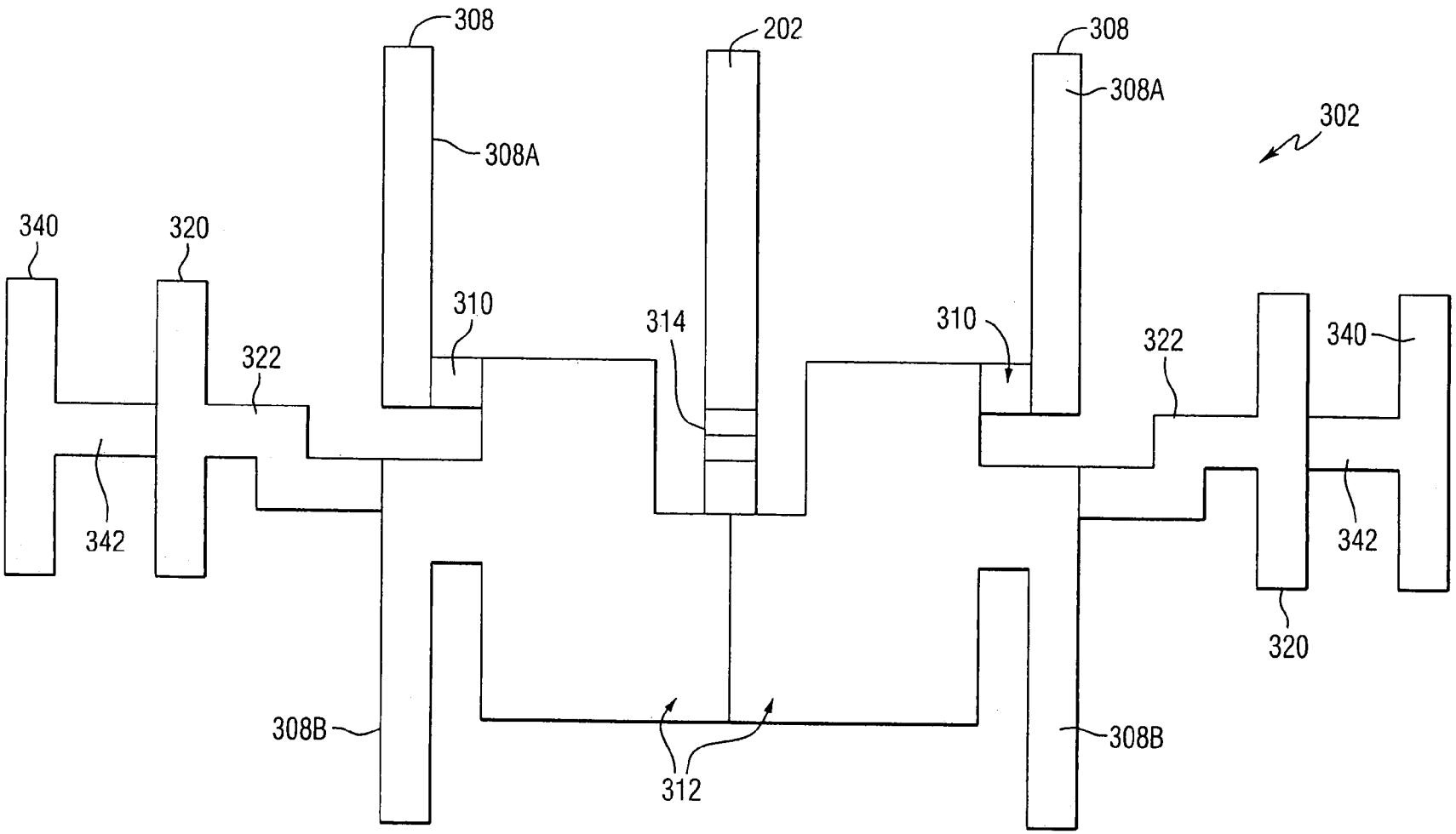
FIG. 19 illustrates a side view of an alternative embodiment of the element of FIG. 17.

FIG. 19 illustrates another embodiment according to the teachings of the present invention, comprising directive parasitic elements 340 (also referred to as short circuit dipole elements) disposed radially outward and electrically connected to the directive parasitic elements 320 via an arm 342. This embodiment provides additional gain along the horizon. Although FIG. 19 illustrates only two such directive parasitic elements 340, in a preferred embodiment each spoke 302 carries a directive parasitic element 340.

Figure 20:
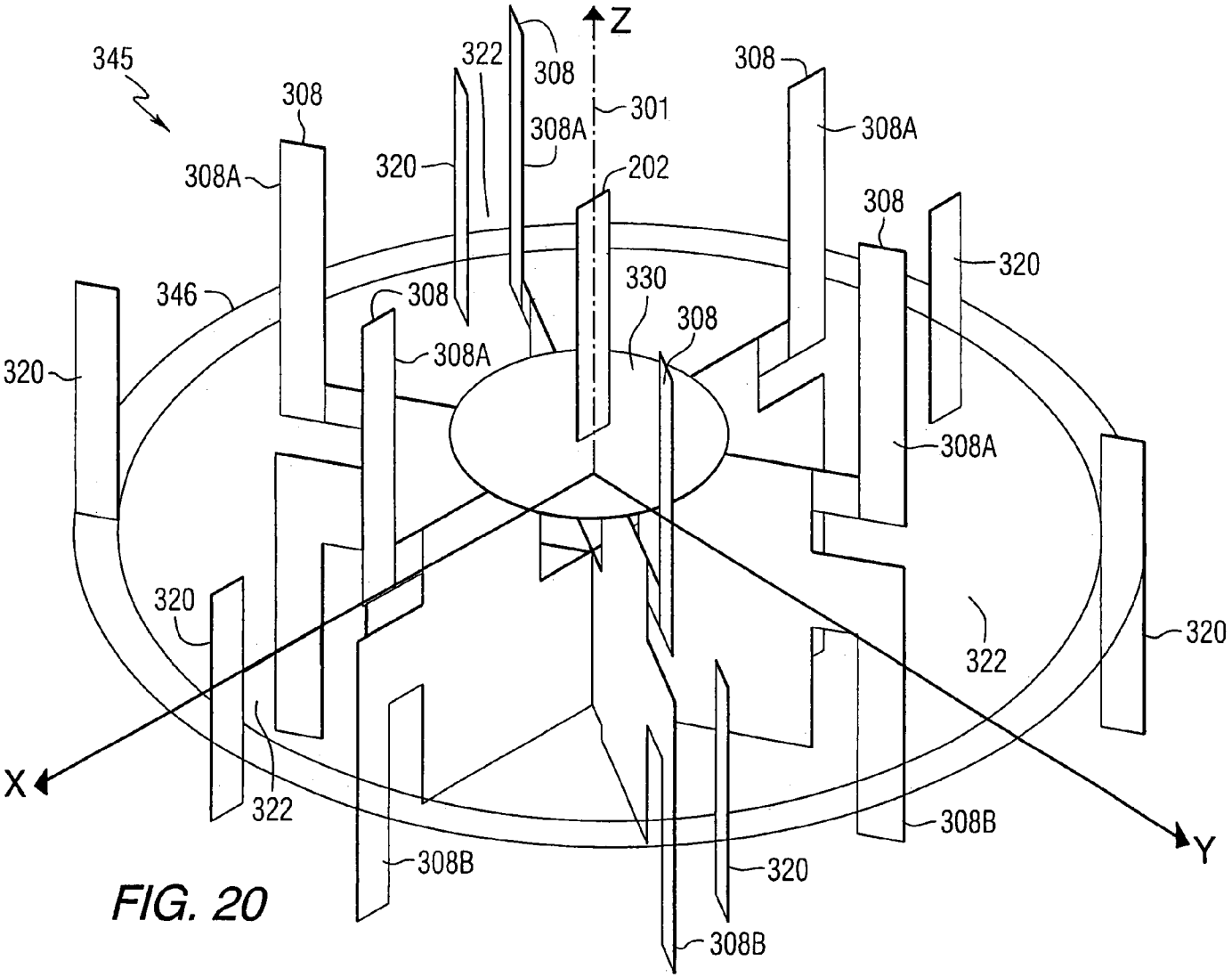
FIG. 20 illustrates a perspective view of yet another antenna constructed according to the teachings of the present invention.

FIG. 20 illustrates another embodiment of an antenna 345 comprising a ring 346 physically connected to and supporting the parasitic directive elements 320, in lieu of the arms 322 illustrated in FIG. 15. The material of the ring 346 comprises a conductor or a dielectric. Use of the ring 346 also provides a support mechanism for the placement of interstitial parasitic elements (not shown in FIG. 20) between adjacent parasitic directing elements 320.

In another embodiment, an antenna comprises an inner core segment (comprising the active element 202 and the passive dipoles 308) and a removable outer segment comprising the parasitic directive elements 320 supported by the ring 346. Thus if the gain provided by the inner core segment is sufficient the outer segment is not required and the antenna space requirements are minimized. If additional directivity is desired, the outer segment is easily and conveniently positioned around the inner core segment.

Figure 21A:
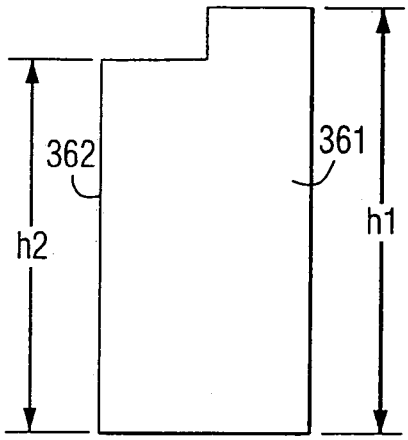
FIGS. 21A–21D illustrate various antenna element shapes for use with an antenna constructed according to the teachings of the present invention.
Figure 21B:
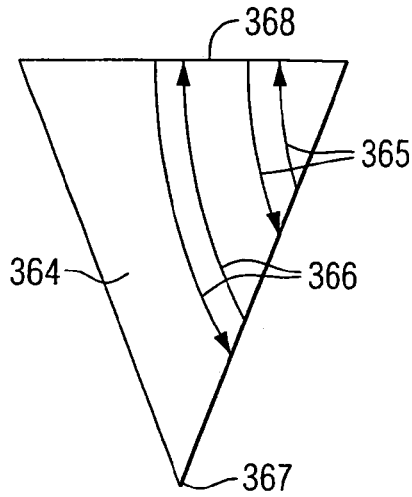
Figure 21C:
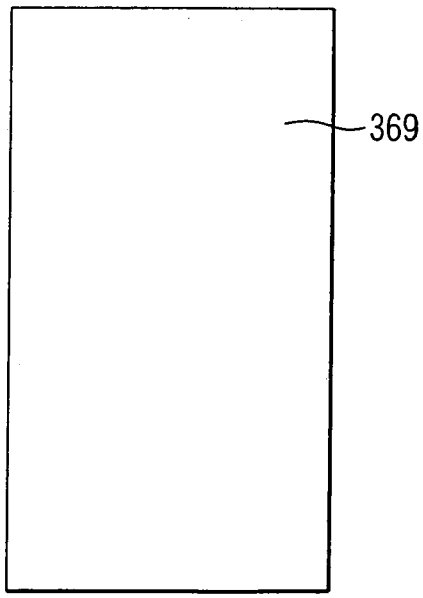
Figure 21D:
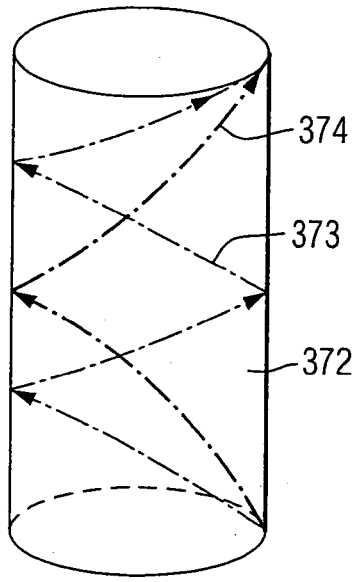

In the above embodiments the active element 202, the dipole elements 308 and the parasitic directing elements 320 and 340 are illustrated as simple linear elements. As can be appreciated by those skilled in the art, other element shapes can be used in place of the linear elements to provide element resonance and reflection characteristics over a wider bandwidth or at two or more resonant frequencies. Several exemplary element shapes are illustrated in FIGS. 21A–21D. An element 360 of FIG. 21A resonates at two different frequencies as determined by the two height dimensions, h1 and h2, where h1 is the longer dimension and therefore a region 361 resonates at a lower frequency than a region 362. Additional resonant frequencies can be obtained by providing additional resonant segments within the element 360. A triangular element 364 of FIG. 21B provides broadband resonance due to the multiple resonant currents that can be established in multiple length paths 365 and 366 (only two exemplary paths are illustrated) between an apex 367 and a base 368. In another embodiment the apex angle and the side lengths can be adjusted to provide log-periodic performance. A fat element such as an element 369 of FIG. 21C provides broader bandwidth performance than the relatively narrower elements described above. A cylindrical element 372 of FIG. 21D is a three-dimensional structure, as compared with the two-dimensional structures of FIG. 20, for example, capable of providing multiple resonant paths as the signal traverses reflective paths, including one of the exemplary paths 373 and 374, as illustrated. Each of the illustrated elements and any other known monopole-type elements can be substituted for the upper segment 308A, and/or the lower segment 308B and/or the parasitic directing elements 320 and 340.

By taking advantage of known harmonic relationships between signal frequencies, the antenna 300 of FIG. 15 can provide multiple resonant frequency operation. It is known that all antennas and antenna arrays exhibit multiple resonances. In particular, dipole elements resonate when the length is near a half wavelength of the operative frequency, and integer multiples thereof. Optimum array elements spacing is similarly harmonically related. Thus the spacing between the active element 202 and the passive dipoles 308, and the length of the passive dipoles 308 can be selected, in one embodiment, so that the antenna 300 resonates at two nearly harmonically related frequencies, such as 5.25 GHz as governed by the IEEE 802.11a standard and 2.45 GHz as governed by the IEEE 802.11b standard. See for example the commonly owned patent application entitled, "A Dual Band Phased Array Antenna Employing Spatial Second Harmonics," filed on Nov. 8, 2002 and assigned application Ser. No. 10/292,384.

Figure 22:
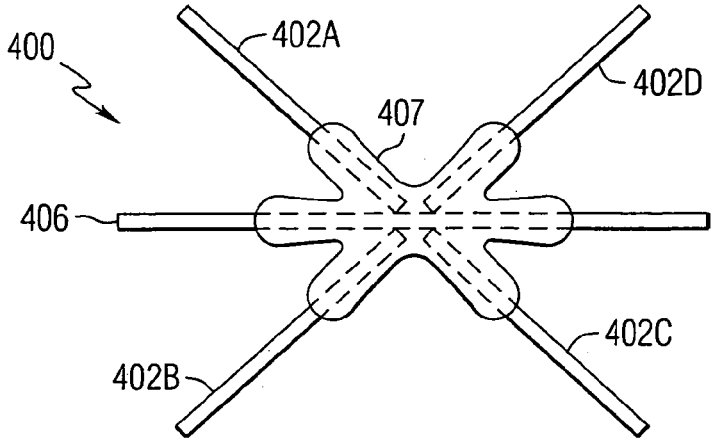
FIG. 22 illustrates another antenna constructed according to the teachings of the present invention.
Figure 23:
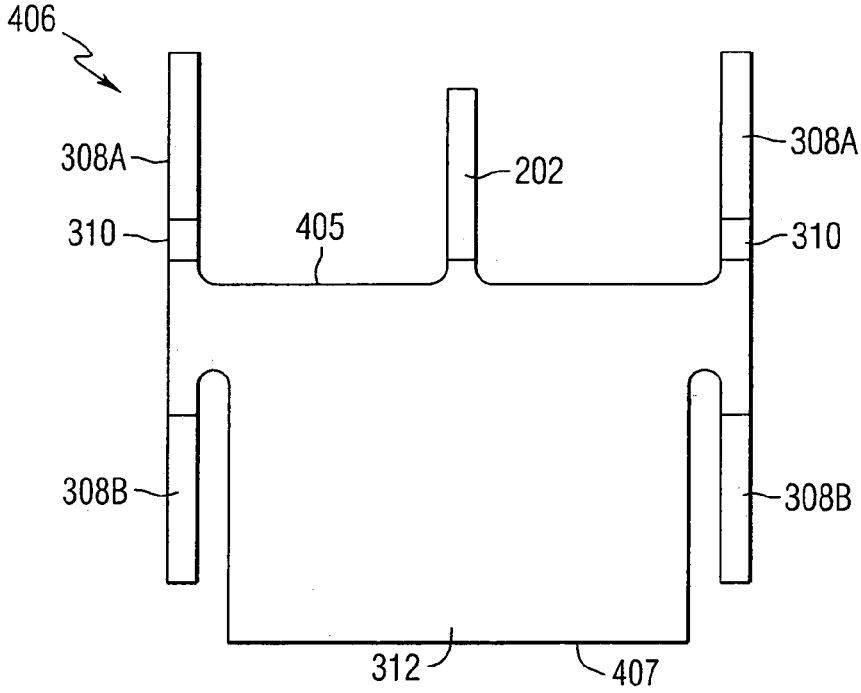
FIGS. 23 and 24 illustrate elements of the antenna of FIG. 22.

FIG. 22 illustrates an antenna 400 constructed according to another embodiment of the present invention, comprising substantially identical sections 402A–402D and a center dual section 406. As illustrated in FIG. 23, the center dual section 406 comprises the ground plane 312 electrically connected to the lower segments 308B. The switch 310 controls operation of the upper segments 308A via the switch 310. Like the upper segments 308A, the active element 202 is physically connected to the center element 202 but insulated from the ground plane conductor. Electronic components (not shown) are mounted on the center dual section 406 for providing radio frequency signals to and receiving radio frequency signals from the active element 202 and for controlling operation of the switches 310. The center dual section 406 and the sections 402A 402D are joined by a support member 407. In another embodiment (not shown) the antenna comprises two support members, including an upper support member disposed proximate an upper surface 405 of the ground plane 312, and a lower support member disposed proximate a lower surface 407. The upper and lower support members join the center dual section 406 and the sections 402A–402D. The material of the support member 407 comprises a conductive, dielectric or composite material (e.g., a conductive material disposed on a dielectric substrate).

Figure 24:
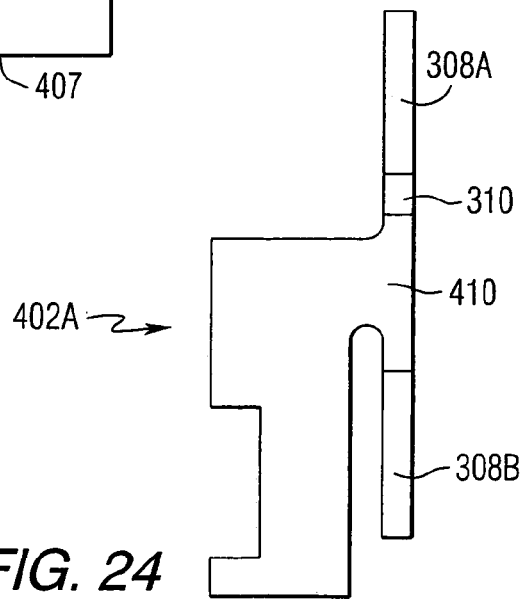

FIG. 24 illustrates the section 402A, comprising a ground plane 410 electrically connected to the ground plane 312 when the sections 402A 402D and the center dual section 406 are assembled to form the antenna 400. The ground plane 410 is electrically connected to the lower segments 308B.

As can be seen, an antenna constructed according to the various embodiments of the invention maximizes the effective radiated and/or received energy along the horizon. The antenna accomplishes the gain improvement by the use of a ring of passive dipoles. Also, by controlling certain characteristics of the passive dipoles the antenna is scanable in the azimuth plane. By providing higher antenna gain for a wireless network, various interference problems are minimized, the communications range is increased, and higher data rate and wider bandwidth signals can be accommodated.

While the invention has been described with reference to a preferred embodiment, it will be understood by those skills in the art that various changes may be made and equivalent elements may be substituted for elements thereof without departing from the scope of the present invention. In addition, modifications may be made to adapt a particular situation more material to teachings of the present invention without departing from the essential scope thereof. Therefore, it is intended that the invention not be limited to the particular embodiment disclosed at the best mode contemplated for carrying out this invention, but that the invention include all embodiments falling within the scope of the appended claims.

What is claimed is:

1. An antenna comprising:

a ground plane;

an active antenna element adjacent said ground plane;

a plurality of passive antenna elements adjacent said ground plane and spaced apart from said active antenna element;

a plurality of first parasitic gratings adjacent said ground plane and spaced apart from said active antenna element, with each first parasitic grating being between two adjacent passive antenna elements; and a controller for selectably controlling said plurality of passive antenna elements for operating in a reflective mode or a directive mode, said controller comprising for each respective passive antenna element at least one impedance element connected to said ground plane, and a switch adjacent said ground plane for connecting said at least one impedance element to said passive antenna element so that said passive antenna element operates in the reflective or directive mode.

2. An antenna according to claim 1 further comprising a plurality of second parasitic gratings adjacent said ground plane and spaced apart from said active antenna element, with each second parasitic grating being radially aligned with a passive antenna element.

3. An antenna according to claim 1 wherein said plurality of first parasitic gratings are arranged in one or more concentric circles from said active antenna element.

4. An antenna according to claim 1 wherein said active antenna element and said plurality of passive antenna elements are sized so that the antenna has a desired operating frequency; and wherein a length of each first parasitic grating is less than half a wavelength of a desired operating frequency.

5. An antenna according to claim 1 wherein said plurality of first parasitic gratings are vertically oriented.

6. An antenna according to claim 1 further comprising a ring structure for supporting said plurality of first parasitic gratings.

7. An antenna according to claim 6 wherein said ring structure is removably positioned outwardly from and concentric with said plurality of passive antenna elements.

8. An antenna according to claim 1 wherein a frequency of a received or transmitted signal comprises a carrier frequency in a wireless system operating according to at least one of the following standards: Code-Division Multiple Access (CDMA), Time Division Multiple Access (TDMA), IEEE 802.11, Bluetooth, and Global System for Mobile (GSM) communications.

9. An antenna according to claim 1 wherein said active antenna element and said plurality of passive antenna elements are vertically oriented.

10. An antenna according to claim 1 wherein said plurality of passive antenna elements are radially spaced from said active antenna element.

11. An antenna according to claim 1 wherein said plurality of passive antenna elements are radially spaced an equal distance from said active antenna element.

12. An antenna comprising:

a ground plane;

an active antenna element adjacent said ground plane;

a plurality of passive antenna elements spaced apart from said active antenna element, each passive antenna element comprising an upper segment adjacent said ground plane and a lower segment connected to said ground plane; and a controller for selectably controlling said plurality of passive antenna elements for operating in a reflective mode or a directive mode, said controller comprising for each respective passive antenna element a first load, a second load, and a switch for connecting said first load between the upper and lower segments so that said passive antenna element operates in the reflective mode, and for connecting said second load between the upper and lower segments so that said passive antenna element operates in the directive mode.

13. An antenna according to claim 12 wherein at least one of said first and second loads comprises an inductive load.

14. An antenna according to claim 12 wherein at least one of said first and second loads comprises a capacitive load.

15. An antenna according to claim 12 wherein directivity of the antenna is increased along a longitudinal plane through said active antenna element.

16. An antenna according to claim 12 wherein antenna radiation is attenuated in a direction perpendicular to a longitudinal plane through said active antenna element.

17. An antenna according to claim 12 wherein each passive antenna element has a first effective electrical length when said first load is connected thereto, and a second effective electrical length when said second load is connected thereto.

18. An antenna according to claim 12 wherein a frequency of a received or transmitted signal comprises a carrier frequency in a wireless system operating according to at least one of the following standards: Code-Division Multiple Access (CDMA), Time Division Multiple Access (TDMA), IEEE 802.11, Bluetooth, and Global System for Mobile (GSM) communications.

19. An antenna according to claim 12 wherein said active antenna element and said plurality of passive antenna elements are vertically oriented.

20. An antenna according to claim 12 wherein said plurality of passive antenna elements are radially spaced from said active antenna element.

21. An antenna according to claim 12 wherein said plurality of passive antenna elements are radially spaced an equal distance from said active antenna element.

22. An antenna according to claim 12 wherein said active antenna element and said plurality of passive antenna elements are sized so that the antenna has a desired operating frequency; and wherein each passive antenna element has a physical length associated therewith that is less than a wavelength of the desired operating frequency.

* * * * *